United States Patent [19]

Hull

[11] 4,121,953

[45] Oct. 24, 1978

[54] HIGH STRENGTH, AUSTENITIC, NON-MAGNETIC ALLOY

[75] Inventor: Frederick C. Hull, Penn Hills Township, Pa.

[73] Assignee: Westinghouse Electric Corp., Pittsburgh, Pa.

[21] Appl. No.: 765,029

[22] Filed: Feb. 2, 1977

[51] Int. Cl.[2] ..... C22C 38/38; C22C 38/58

[52] U.S. Cl. ..... 148/38; 75/126 B; 75/126 C; 75/126 E; 75/126 F; 75/126 J; 75/128 A; 75/128 G; 75/128 N; 75/128 V; 75/128 W

[58] Field of Search ..... 75/128 A, 126 B, 126 F, 75/128 N, 128 G, 128 W, 128 V, 126 C, 126 E, 126 J; 148/38

[56] References Cited

U.S. PATENT DOCUMENTS

| | | | |
|---|---|---|---|
| 2,711,959 | 6/1935 | DeLong | 75/128 A |
| 2,814,563 | 11/1957 | Dyrkacz et al. | 75/126 B |
| 3,065,069 | 11/1962 | Manganello et al. | 75/128 A |
| 4,017,711 | 4/1977 | Honma | 75/126 B |

FOREIGN PATENT DOCUMENTS

| | | | |
|---|---|---|---|
| 562,401 | 8/1958 | Canada | 75/128 A |
| 47-37,336 | 8/1968 | Japan | 75/128 A |

*Primary Examiner*—Arthur J. Steiner
*Attorney, Agent, or Firm*—R. T. Randig

[57] ABSTRACT

A cold-worked, high strength, non-magnetic, austenitic, ferrous alloy having high resistance to stress-corrosion cracking and hydrogen embrittlement. Composition of this alloy in weight percent is:

| | |
|---|---|
| Manganese | 17 to 23 |
| Chromium | >6 to <10 |
| Carbon | 0.35 to 0.8 |
| Silicon | up to 1.5 |
| Nickel | up to 2.75 |
| Molybdenum | up to 3.5 |
| Vanadium | up to 1.7 |
| Columbium | up to 0.45 |
| Nitrogen | up to 0.8 |
| Iron | Balance |

with carbon plus nitrogen 0.35 to 0.8 and the manganese plus chromium between 24 and 31.5. Also a large electrical generator with retaining and baffle rings of the alloy. Also a method of hardening this alloy by cold working and aging.

17 Claims, 24 Drawing Figures

HIGH STRENGTH, AUSTENITIC, NON-MAGNETIC ALLOY

REFERENCE TO RELATED DOCUMENTS

1. L. F. Trueb, Corrosion, Vol. 24 (11), pp. 355–358 (1968).
2. C. Gibbs, Institution of Mechanical Engineers, Vol. 169(29), pp. 511–538 (1954).
3. Metal Progress, Vol. 70(1), pp. 65–72 (1956).
4. O. Lissner, Engineers Digest, Vol. 18(12), pp. 571–574 (1957).
5. M. O. Speidel, Corrosion, Vol. 32(5), pp. 187–190 (1976).
6. H. Kohl, Werkstoffe und Korrosion, Vol. 14, pp. 831–837 (1963).
7. F. C. Hull, Welding Journal, Vol. 52(5), Research Supplement, pp. 193s to 203s (1973).
8. R. A. McCoy, D. Engrg. Thesis, Lawrence Berkeley Laboratory Report 135, Sept. 1971.
9. Abex, U.S. Pat. No. 3,075,838, Jan. 29, 1963.
10. K. Bungardt and A. Steinen. Discussion of paper by Kroneis and Gattringer, Ref. 13.
11. S. J. Manganello and M. H. Pakkala, U.S. Pat. No. 3,065,069, Nov. 20, 1962.
12. A Suzuki, et al., Tetsu to Hagane, Vol. 49(10), pp. 1551–1553 (1963). H. Brutcher Trans. 6223.
13. M. Kroneis and R. Gattringer, Stahl und Eisen, Vol. 81(7), pp. 431–445 (1961).
14. Standard Steel Co., Experimental Alloy.
15. Japan Steel Works, Commercial Alloy — MV3.
16. General Electric Company, U.K. Pat. No. 1,127,147, Sept. 11, 1968.
17. Composition range of material used by Westinghouse Electric Corporation.
18. F. Leitner, U.S. Pat. No. 2,156,298, May 2, 1939.
19. V. Cihal and F. Poboril, Revue de Met., pp. 199–208, March 1969.
20. W. C Clarke, Jr., U.S. Pat. No. 2,815,280, Dec. 3, 1957.
21. W. W. Dyrakacz, U.S. Pat. No. 2,824,798, Feb. 25, 1958.
22. R Schempp, P. Payson and J. Chow, U.S. Pat. No. 2,799,577, July 16, 1957.
23. M. Fleischmann, U.S. Pat. No. 2,724,647, Nov. 22, 1955.
24. S. M. Norwood, U.S. Pat. No. 2,405,666, Aug. 13, 1946.
25. Gebr. Bohler, French Pat. No. 1,078,772, Nov. 23, 1954.
26. W. T. DeLong and G. A. Ostrom, U.S. Pat. No. 2,789,048, Apr. 16, 1957.
27. W. T. DeLong and G. A. Ostrom, U.S. Pat. No. 2,789,049, Apr. 16, 1957.
28. W. T. DeLong and G A. Ostrom, U.S. Pat. No. 2,711,959, June 28, 1955.
29. W. W. Dyrakcz, E. E. Reynolds and R. R. MacFarlane, U.S. Pat. No. 2,814,563, Nov. 26, 1957.
30. W. C. Clarke, Jr., U.S. Pat. No. 2,850,380, Sept. 2, 1958.
31. Gebr. Bohler, Commercial Alloy.
32. P. A. Jennings, U.S. Reissue 24,431, Feb. 11, 1958.
33. C. M. Hsiao and E. J. Dulis, Trans. ASM, Vol. 49, pp. 655–685 (1957). Trans. ASM, Vol. 50, pp. 773–802 (1958).
34. P. A. Jennings, U.S. Pat. No. 2,602,738, July 8, 1952.
35. P. A. Jennings, U.S. Pat. No. 2,671,726, Mar. 9, 1954.

36. G. E. Linnert and R. M. Larrimore, U.S. Pat. No. 2,894,833, July 14, 1959.
37. M. G. Gemmill, U.K. Pat. No. 838,294, June 22, 1960.
38. M. Korchynsky and W. Craft, U.S. Pat. No. 2,955,034, Oct. 4, 1960.
39. R. Franks, W. O. Binder and J. Thompson, Trans. ASM Vol. 47, pp. 231–266 (1955).
40. Y. Araki, Japanese Pat. No. 1958–4059, May 24, 1958.
41. W. L. Lutes and H. F. Reid, Jr., Welding Journal, Vol. 25(8), pp. 776–783 (1956).
42. W. F. Furman and H. T. Harrison, U.S. Pat. No. 2,892,703, June 30, 1959.
43. E. J. Whittenberger, E. R. Rosenow and D. J. Carney, Trans. AIME, Vol. 209, pp. 889–895 (1957).
44. F. M. Becket, U. K. Patent No. 361,916.
45. F. M. Becket, U.K. Patent No. 366,060, Jan. 28, 1932.
46. F. M. Becket and R. Franks, U.K. Patent No. 480,929, Mar. 2, 1938.
47. F. M. Becket, U.K. Pat. No. 388,057, Feb. 20, 1933.
48. U.K. Patent No. 497,010, Dec. 9, 1938.
49. W. T. DeLong and H. F. Reid, Jr., Welding Journal, Vol. 36(1), Research Suppl., pp. 41s to 48s (1957).
50. R. H. Aborn, Metal Progress, Vol. 65(6), pp. 115–125 (1954).
51. G. Riedrich and H. Kohl, Berg-und Huttenmannische Monatshafte, Vol., 108(1), pp. 1–8 (1963).
52. D. J. Carney, U.S. Pat. No. 2,778,731, Jan. 22, 1957.
53. I. S. Gunsburg, N. A. Aleksandrova and L. S. Geldermann, Arch. fur dar Eisenhuttenwesen, Vol. 8, pp. 121–123 (1933–34).
54. American Silver Company, Commercial Alloy — MAGNIL.
55. D'Imphy — Commercial Alloy — NM FX-1 and 2.
56. C. E. Spaeder, J. C. Majetich and K. G. Brickner, Metal Progress, Vol. 96(7), pp. 57–58 (1969).
57. Crucible Steel Co., Commercial Alloy.
58. R. B. Benson, et al., Conference on Stress Corrosion Cracking and Hydrogen Embrittlement, Unieux-Firminy, France, June 10–16, 1973.
59. R. Franks, U.S. Pat. No. 2,256,614, Sept. 23, 1941.
60. Armco Steel Company Commercial Alloy — Armco-22-4-9.
61. P. Payson, U.S. Pat. No. 2,805,942, Sept. 10, 1957.
62. J. J. Heger, J. M. Hodge and R. Smith, U.S. Pat. No. 2,865,740, Dec. 23, 1958.
63. W. Prause and H. J. Engell, Werkstoffe and Korrosion, Vol. 20(5), pp. 396–407 (1969).
64. A. Baumel, Werkstoffe und Korrosion, Vol. 20(5), pp. 389–396 (1969).

BACKGROUND OF THE INVENTION

This invention relates to the metallurgical art and has particular relationship to high-strength, austenitic, non-magnetic alloys which are used in environments where they are subject to stress-corrosion cracking and/or to hydrogen embrittlement. Such alloys have general utility but they are uniquely suitable for use in the parts of large electrical generators (typically 1250 megawatt generators) and particularly for the end-winding retaining rings and the baffle rings of such generators. In the interest of facilitating the understanding of this invention, this application, in dealing with the use of the alloys, is confined to a specific concrete problem, namely, to such use in retaining rings and baffle rings of large generators. It is not intended that this treatment of the alloys in this application shall in any way restrict the scope of this invention. It is an object of this invention to provide wrought, austenitic, non-magnetic alloys, having general utility but being uniquely suitable for the above-mentioned parts of generators, which are characterized by a high rate of work hardening during cold working, i.e., characterized by a large increase in hardness or yield strength for a given degree of cold working, and also have high resistance to stress-corrosion cracking and hydrogen embrittlement.

A rotor of a large generator consists essentially of a single large forging, the main body of which contains a number of longitudinal slots which hold the copper conductors of the DC field winding. The conductors are retained in the slots by means of non-magnetic metal wedges anchored in grooves near the top of each slot. At the ends of the main body of the rotor the conductors emerge from the slots to join circumferential arc portions of the windings, thus forming a continuous series coil wound around the unslotted pole portions of the forging. That portion of the winding beyond each end of the forging body is called the end turn and must be retained against the centrifugal forces acting upon it up to speeds 20% above normal operating speeds (typically 3600 RPM) and higher. This retaining function is performed by the retaining ring. The ring rotates with the rotor and in addition to the load from the copper end turns to which it is subject, it is subject to an additional hoop stress which is proportional to the ring density and its mean radius. In fact, for steel alloys, about 68% of the ring stress is caused by the ring mass itself.

An essential feature of the rotor construction is that the ring is shrunk onto a fit on the rotor body at one end of the ring. The interference at the fit is sufficient to assure that looseness will not occur at 20% overspeed (4320 RPM for a rated 3600 RPM 2-pole machine). Insulation must be provided between the winding and the ring for voltages in the range 300–700V DC.

For many decades there has been continuous demand for increased ratings of turbine generators. This demand has necessitated corresponding increases in rotor diameters, to achieve these increased ratings without excessive rotor lengths. Increases in rotor diameters demand higher stresses in all rotating parts and higher strength materials are required. The highest stressed components of a rotor are the retaining rings.

The processing steps in the manufacture of a retaining ring involve electric furnace melting, sometimes electroslag remelting to get a cleaner ingot and a minimum of segregation, hot forging, hot piercing, hot expanding, solution treatment, quenching, cold expansion and stress relief anneal. The high yield strength of rings is obtained by cold expansion which may be accomplished by mechanical means with wedges, by hydraulic pressure, or by explosive forming. Sometimes, combinations of these techniques may be used. In the case of explosive forming, there is evidence that the intensity of shock wave loading should be minimized to avoid increasing susceptibility to stress-corrosion cracking.

Briefly, some of the desired characteristics of a retaining-ring material are the following: a high yield strength to avoid plastic deformation under high stress, a low density and high elastic modulus to minimixe deflection during overspinning, and a high thermal expansion coefficient to minimize the temperature required for the shrink fit (to avoid thermal damage to the electrical insulation).

Another desideratum is that the retaining rings be non-magnetic. The use of magnetic rings on a rotor results in greater magnetic end flux leakage with resulting extra heating in the stator coil ends and iron losses in the end region of the core. Additional excitation is required to compensate for this leakage and total machine efficiency is reduced.

The most pessimistic assumption on the exposure of a retaining ring to fatigue stresses is that the turbine-generator would be started and stopped once a day and subjected to a 10% overspeed test once a month during its lifetime. A 30 to 40 year life thus corresponds to a maximum of about 14,500 stress cycles. In the case of retaining rings, there is thus a low-cycle fatigue requirement.

Baffle rings are annular members approximately 2 in. square that are shrunk onto the rotor body at several positions along the length to channel the flow of the cooling gas. Baffle rings are made by the same process and from the same alloy as the retaining rings and have essentially the same property requirements.

Retaining and baffle rings in service in hydrogen-cooled generators are exposed to a pressure of from about 15 to 85 psig dry hydrogen gas, so that alloys for these applications should be resistant to static-load hydrogen-assisted crack propagation (hydrogen embrittlement). The case for requiring high resistance to stress-corrosion cracking is not as obvious, since the generator environment does not normally expose these materials to stress-corrosion conditions. However, a water leak in a foreign-built water-cooled generator recently caused stress-corrosion failure of a retaining ring having a composition in accordance with the teachings of the prior art.

Moreover, during steps in fabrication of rings or during storage or shipment there are numerous opportunities for accidental exposure to potentially corrosive environments, such as moist industrial or marine atmospheres, salt spray, welding flux fumes, fire extinguisher powders, liquid spills or leaks and snow or rain. The residual stresses from cold forming were sufficient to cause stress-corrosion cracking of some early retaining rings exposed to these conditions (Document 2). Even higher stresses are present after the ring is shrunk onto the rotor or from centrifugal forces when the generator is running. There have been several instances of retaining ring failures during generator operation that were attributed to stress-corrosion cracking (Documents 3 and 4).

The most searching method for evaluating the suitability of materials for service in a generator is by environmental testing of fracture toughness specimens. Fatigue precracked WOL (wedge-opening-loading) or CT (compact tension) specimens, preferably large enough to provide plane-strain loading conditions, are tested in various environment, such as salt water, $H_2$ or $H_2S$, for static crack growth rate ($da/dt$) as a function of stress intensity for determination of $K_{ISCC}$, $K_{IH_2}$, or $K_{IH_2S}$, and fatigue crack growth rate ($da/dN$) as a function of $\Delta K$.

$a$ is crack length.

N is number of cycles of fatiguing.

$\Delta K$ is the stress intensity range used in fatiguing the specimen.

($da/dN$) is change in crack length per cycle of fatiguing.

($da/dt$) is change in crack length per unit time.

$K_{ISCC}$ is a threshold stress intensity, ksi $\sqrt{\text{in.}}$, below which a sharp crack will not grow under plane-strain conditions in a corrosive environment, such as salt water, hydrogen or hydrogen sulphide gas. $K_{ISCC}$ depends upon composition of the environment and temperature, pressure and time of exposure. $K_{IH_2}$ (apparent), for example, represents the stress intensity for crack propagation in 80 psig hydrogen gas at room temperature (70° F) with a loading rate of 20 pounds/minute in a rising load test (performed with the apparatus shown in FIG. 4).

$K_{IH_2}S$.

$K_{Ic}$, the plane-strain fracture toughness, measures the resistance of a material to fracture in a neutral environment in the presence of a sharp crack under severe tensile constraint, such that the state of stress near the crack front approaches tritensile plane-strain, and the crack-tip plastic region is small compared with the crack size and specimen dimensions in the constraint direction. Calculation of $K_{Ic}$ is based on procedures established in American Society for Testing and Materials Standard E339–72.

There are many Cr-Mn-Ni-C-N-X steels in the prior art (X stands for one or more additional alloying elements, such as Mo, W, V, Cb, etc.). Although some of these steels may contain the same elements as are present in alloys according to this invention, they differ in quantity and proportion of alloying elements in one or more substantial ways from the alloy of this invention. The following Table I shows compositions of a number of these alloys, including several which have been used and have been proposed for use for retaining rings and baffle rings of large high power generators. The compositions of Table I are disclosed in the Related Documents above. The number in the third column of Table I is the number of the Related Document where the composition listed in the corresponding row is disclosed. By far, most of the items in Table I are not used or intended for retaining rings and baffle rings for large generators, but are actually used for entirely unrelated purposes, such as welding materials in the as-deposited condition or high-temperature alloys in the solution treated condition. Such alloys are not normally cold-worked. The numbers in the third column from the left in this table refer to items in "Reference to Related Documents".

Since it has been found that Cr is the most important element (although not the only one), in controlling stress-corrosion cracking of material that is rapidly cooled some prior art alloys are arranged in the order of increasing Cr contents in Table I for convenience of discussion.

TABLE I

Prior Art Mn-Cr-Ni Alloys - Balance Essentially iron

| Proposed By | Designation | Ref.* No. | Cr | Mn | Ni | C | N | Si | Mo | W | V | Cb | Ta | Ti | Cu | P | B | Other |
|---|---|---|---|---|---|---|---|---|---|---|---|---|---|---|---|---|---|---|
| McCoy | E9 | 8 | 0 | 16 | | .3 | | | | | | | | | | | | |
| McCoy | E5 | 8 | 0 | 20 | | .26 | | | | | | | | | | | | |
| McCoy | E3 | 8 | 0 | 25 | | .29 | | | | | | | | | | | | |
| Abex | | 9 | 0 | 14 | 2 | .45 | | | 2 | | .8 | | | | | | | |
| Baumel | 6 | 64 | .26 | 20.8 | .1 | .46 | .002 | | | | | | | | | | | 2.03 Co |
| Bungardt | | 10 | 3.9 | 9.2 | 8.4 | .7 | | | | | 2.04 | | | | | | | |
| Manganello | | 11 | 4–5 | 1.75–19.5 | | .45–.6 | .06–.12 | | | | | .2–.5 | | | | | | |
| Suzuki | | 12 | 4.7 | 18 | 1.9 | .42 | .01–.1 | | | | | | | | | | | |
| Kroneis | | 13 | 5 | 18 | | .36 | .12 | | | | | | | | | | | |
| Speidel | | 5 | 5 | 18 | .1 | .5 | | | | | | | | | | | | |
| Standard Steel | | 14 | 5 | 18 | | .5 | | | | | .5–1.8 | | | | | | | |
| Japan Steel | MV3 | 15 | 5 | 18 | | .5 | | | 3 | | .8 | | | | | | | |
| McCoy | E7 | 8 | 5 | 15 | | .3 | | | | | | | | | | | | |
| General Elec. | | 16 | 3.5–6 | 16.5–20.5 | | .4–.6 | | | | | .25–1 | | | | | | | |
| Westinghouse | | 17 | 4–6 | 16–20 | <2 | .4–.6 | Opt. | | <.5 | <.5 | <.2 | Opt. | | | | | | |
| Leitner | | 18 | 5–25 | 3–18 | 3–27 | <.3 | | | .3–6 | .3–6 | | | | | | | | Σ V,Ti,Ta,Zr,Co,Si<3; Mo+W = .3–6 |
| Cihal | 17483 | 19 | 8.2 | 19.4 | | .13 | .04 | .37 | .56 | | .49 | | | | | | | |
| Clarke | | 20 | 9–14 | 4–20 | 4–10 | .1–.4 | <.3 | | 0–3.5 | 0–3.5 | 0–.75 | | | | | .15–.35 | | C+N > .3 |
| Dyrkacz | | 21 | 9–15 | 8–15 | | .6–1 | | .25–1.25 | 1.5–4 | | | | | | | | | |
| Heger | 21 | 62 | 8.0 | 8.7 | 4.1 | .38 | | | | | .43 | | | | | | | |
| Heger | 21 | 62 | 0–20 | * | 0–12 | .25–1 | | | 1–4 | | .3–3 | | | | | | | 1.2–4 Al, *Sufficient Mn to form austenite |
| Prause | 365 | 63 | 8.0 | 23.9 | – | .02 | .16 | | | | | | | | | | | |
| Japan Steel | | 15 | 10 | 18 | | .5 | | | | | 1.7 | | | | | | | |
| Japan Steel | | 15 | 10 | 18 | | .5 | | | 3 | | 1.5 | | | | | | | |
| Schempp | | 22 | 10–30 | .5–15 | 3–25 | .2–.3 | <.4 | <3 | <3 | <3 | | | | | | .15–1 | | 0–3 Mo+W; Ni + Mn = 12–30; C+P > .45 |
| Fleischmann | | 23 | 10–20 | 5–10 | 10–20 | <.1 | .1–.2 | .4 | 4–8 | | | | | | | | | |
| Norwood | | 24 | 10–30 | .5–7 | 4–30 | .01–.5 | 0–.2 | | | | .05–.25 | 10×C | | | | | | |
| Bohler | | 25 | 10–23 | 4.7–9 | 5.5–10.2 | .08–.2 | | .8–1.5 | | | | | | .01–.5 | | | | |
| Cihal | 17482 | 19 | 10.8 | 18.1 | | .10 | .02 | .5 | | | .55 | | | | | | | |
| DeLong | | 26 | 11–20 | 10.5–19 | 0–4 | .15–.5 | 0–.3 | | 0–5 | 0–5 | 0–2 | 0–2 | | | | | | Mn + 2 Ni = 13–22 |
| DeLong | | 27 | 11–21 | 9–19 | 0–4 | .2–.6 | 0–.3 | | 0–5 | 0–5 | 0–2 | 0–2 | | | | | | Mn + 2 Ni = 13–22 |
| DeLong | | 28 | 11–21 | 9–19 | 0–4 | .2–.85 | 0–.3 | | 0–5 | 0–5 | 0–2 | 0–2 | | | | | | 0–5 Mo+W; 0–2 V+Cb |
| Drykacz | | 29 | 11.5–13.5 | 16–20 | | .2–.4 | .1–.25 | .15–.75 | 2–4 | | .6–.95 | | | | | | .1–.4 | |
| Clarke | | 30 | 11.5–15.5 | 0–16 | 0–8 | 0–.2 | 0–.2 | 0–0–3 | | | 0–1 | | | 1–5 | | | 0–.5 Ti, S, Se, Be | |
| Bohler | | 31 | 12 | 18 | 2.2 | .06 | 1.05 | .57 | .6 | | | | | | | | | |
| Kohl | | 6 | 12 | 18 | 1.9 | .15 | .15 | | .5 | | | | | | | | | |
| Jennings | | 32 | 12–30 | 7–20 | .3–.6 | .01–1 | .3–.6 | <4 | 0–9 | | | | | | | | | C + N > .4 |
| Hsiao | | 33 | 12–28 | 10–28 | .15 | .1–.8 | .1–.8 | .25 | | | | | | | | | | |
| Jennings | | 34 | 12–30 | 3–12 | 2–35 | .08–1.5 | .06–.4 | <.45 | | | | | | | | | | |
| Jennings | | 35 | 12–30 | 3–12 | 2–35 | .08–1.5 | <.6 | <.45 | 1.5–9 | | | | | | | | | |
| Linnert | | 36 | 12–30 | 14.7–23.1 | 7–35 | <.08 | | <3 | 0–4 | | | 0–1.5 | | 0–1.5 | 0–5 | | | |
| Gimmill | | 37 | 12–18 | 3–10 | 6–10 | .05–.25 | | | .5–4 | 0–3.5 | 0–1.75 | .25–2 | | | | | | Mo + W < 4; Cb + V < 2 |
| Korchynsky | | 38 | 12–25 | 10–20 | 4–18 | <.6 | .1–.6 | | 2–6 | 1–4 | | | | | | | | |
| Franks | | 39 | 12–18 | 1–22 | 0–14 | 0–.1 | .05–.18 | | | | | | | | | | | |
| Kroneis | A6 | 13 | 13.5 | 19.5 | .12 | .25 | | | | | | | | | | | | |
| Kroneis | A7 | 13 | 14 | 25 | .50 | .25 | | | | | | | | | | | | |
| Araki | | 40 | 14–22 | 4–13 | 5–18 | .1–.4 | <.5 | | .5–4 | 1–4 | | <4 | | <2.5 | | | | |
| Lutes | | 41 | 14.5 | 14 | 1 | .35 | | .62 | 1.65 | | .62 | | | | | .026 | | |
| Kroneis | B1 | 13 | 14.6 | 20.6 | | .53 | .20 | | | | 1.3 | | | | | | | |
| Furman | | 42 | 15–25 | 5–15 | 10–25 | .3–.5 | .05–.5 | .9–1.5 | | | | .75–1.5 | | | | | | |
| Whittenberger | | 43 | 15–21 | 12–18 | 0–3 | .1 | .25–.45 | .5 | | | | | | | | | | |
| Suzuki | | 12 | 15.6 | 20.7 | | .56 | .25 | .55 | | | 2 | | | | | | | |
| Becket | | 44 | 16–22 | 5–15 | | <.3 | | | | | | | | | | | | |
| Becket | | 45 | 16–22 | 5–15 | | <.3 | | | | | | | | | 0–3 | | | |

TABLE I-continued

| Proposed By | Designation | Ref.* No. | Cr | Mn | Ni | C | N | Si | Mo | W | V | Cb | Ta | Ti | Cu | P | B | Other |
|---|---|---|---|---|---|---|---|---|---|---|---|---|---|---|---|---|---|---|
| Prior Art Mn-Cr-Ni Alloys - Balance Essentially iron | | | | | | | | | | | | | | | | | | |
| Becket | | 46 | 16–22 | 5–14 | | <.12 | | | | | | .2–1 | | | | | | |
| Becket | | 47 | 16–22 | 3–12 | 2–11 | <.3 | | | | | | | | | | | | Mn + Ni = 6–14 |
| Becket | | 48 | 16–22 | 5–11 | 3–6 | <.15 | | | | | | .25–1.5 | .25–2 | | | | | Mn > Ni; Mn + Ni < 14 |
| DeLong | | 49 | 16 | 16 | 1 | .25–.45 | | | 0–4 | 0–4 | 0–2 | 0–1 | | | | | | |
| Aborn | | 50 | 16 | 17 | 1 | .15 | | | | | | | | | | | | |
| Reidrich | 68 | 51 | 16.6 | 12 | 1.2 | <.06 | .2–.25 | <.2 | | | | | | | .3–.5 | | | |
| Cihal | 17460 | 19 | 17–20 | 7–10 | 4–6 | <.12 | .12–.25 | <.9 | | | | | | | | | | |
| Carney | | 52 | 17–18.5 | 14–20 | .05–1 | .06–.15 | .25–1 | .25–1 | | | | | | | | | | |
| Gunsburg | | 53 | 17–18 | 2–8.7 | 2–6.3 | .12–.4 | | .4–.65 | | | | | | | | | | |
| Amer. Silver | Magnil | 54 | 17–19 | 14.5–16 | <.75 | .08–.12 | >.35 | .3–1 | | | | | | | | | | |
| d'Imphy | NMFX1 | 55 | 17.3 | 12 | | .12 | .37 | .27 | | | | | | | | | | |
| Spaeder | | 56 | 18 | 15 | 5.5 | .08 | .4 | .4 | | | | | | | | | | |
| d'Imphy | NMFX1 | 55 | 18 | 12 | | .2 | .37 | .4 | | | | | | | | | | |
| Crucible | Gaman R | 57 | 18 | 12.5 | | .2 | .35 | .4 | | | | | | | | | | |
| Benson | | 58 | 18 | 15.9 | 5.5 | .08 | .4 | .4 | | | | | | | | | | |
| Franks | | 59 | 20–30 | 2–6 | 5–25 | .01–.5 | .01–.5 | | | | | | | | | | | .5–3.5 Mo, Ti or Cb |
| Armco | 22-4-9 | 60 | 20–23 | 7–10 | 3–5 | .45–.6 | .3–.5 | <1 | | | | | | | | | | |
| Payson | | 61 | 21–27 | 9–15 | | .55–.8 | .3–.5 | 0–2.5 | 0–2 | 0–2 | 0–2 | | | | | | | |

*See Reference to Related Documents.

The preferred prior art alloys for use for retaining rings and baffle rings have been steel alloys including, in weight percent, 18 manganese, 5 chromium and 0.5 carbon and, as shown in Table I, small quantities of other elements in addition to iron. As shown in Table I, there are many alloys for other purposes which contain in excess of 10% by weight chromium and also contain manganese in appreciable or substantial quantities.

The 18 Mn-5 C-0.5 C alloy has been cold worked to ever increasing yield strengths in attempts to meet the demands of increased rotor sizes. When environmental factors are considered, the strength limit for this alloy has essentially been reached. Further increases in rotor diameters will demand the use of retaining ring materials of higher strength than is afforded by the prior art alloys and with improved resistance to degradation in the service environment at these high strength levels.

This need for an improved alloy has been demonstrated by field experience and by studies which have been conducted. For example, M. O. Speidel recently used the fracture mechanics approach to evaluate the properties of an explosively formed 18 Mn-5 Cr-0.5 C retaining ring. At a yield strength of 174 ksi and with the excellent fracture toughness in air of 133 ksi $\sqrt{\text{in.}}$, the threshold stress intensity, $K_{ISCC}$, for propagation of a crack in various aqueous solutions was only 6.4 ksi $\sqrt{\text{in}}$. This would correspond to a critical flaw size below the limit of detection by the best ultrasonic inspection techniques, which means that undetected flaws could grow in the service environment to a size that would cause failure by the $K_{Ic}$ criterion.

Another limitation of the current 18 Mn-5 Cr-0.5 C alloy is that it readily becomes sensitized and this has an adverse effect on stress-corrosion cracking resistance. For example, Kohl (Document 6) has shown that sensitization, from inadvertent or deliberate aging in the temperature range of rapid carbide precipitation, can increase susceptibility to stress-corrosion cracking. Since retaining rings are massive forgings of thick cross section and low thermal conductivity, it is possible that carbide precipitation, principally at grain boundaries, could occur, especially in the midwall position in the ring, during cooling from the solution temperature through the critical temperature range of about 1400°–1000° F (760°–538° C) unless particular attention is paid to obtaining the best possible quench, as by using a large volume of cold quenching fluid with vigorous spray or agitation.

Under the most favorable quenching conditions, the cooling rate at the midwall position of a 5.7 in. thick ring of prior art alloy has been measured as 2.2° F/sec (1.4° C/sec). The cooling rate at the center of the retaining ring is important, as well as that at the surface, because, after being expanded as a simple hollow cylinder, machining of the end to shape exposes the interior of the ring to the environment. There is a small benefit in cooling because of heat extraction from the end during the quench, but the effect is not great 3½ in. from the end. Moreover, material is frequently removed from the end of the ring for qualification mechanical tests, which would increase the effective quenching distance.

It is accordingly an object of this invention to surmount the difficulties and disadvantages of the prior art and to provide alloys which, while having general applicability, shall be uniquely suitable for retaining rings and baffle rings of large generators of ever increasing ratings. It is also an object of this invention to provide a generator whose retaining rings and baffle rings are composed of these alloys. It is also an object of this invention to provide a method for increasing the strength of these alloys.

Another object of this invention is to provide cold worked, austenitic, non-magnetic alloys that can be aged to increase hardness and yield strength and yet retain good resistance to stress-corrosion cracking and hydrogen embrittlement.

A further object of this invention is to provide an austenitic alloy composition that can be solution-treated and quenched in heavy sections up to about 4 to 6 in. thick and then be cold worked to a high-strength level and still be substantially non-magnetic and resistant to stress corrosion cracking and hydrogen embrittlement even when the interior of a heavy section, exposed by machining, is subsequently subjected to hostile environments during manufacture, storage or service.

It is also an object of this invention to provide alloys substantially less sensitive to stress corrosion cracking and hydrogen embrittlement than the prior art alloys of Table I.

Also, it is an object of this invention to provide manganese, chromium, carbon steel alloys having a yield strength of about 170 to 210 ksi, particularly for large electric generator parts, which alloys should be resistant to stress-corrosion cracking and hydrogen embrittlement.

SUMMARY OF THE INVENTION

In accordance with this invention, alloys are provided having essentially the following compositions in weight percent:

| | |
|---|---|
| Manganese | 17 to 23 |
| Chromium | >6 to <10 |
| Carbon plus Nitrogen | 0.35 to 0.8 |
| Nickel | up to 2.75 |
| Silicon | up to 1.5 |
| Molybdenum | up to 3.5 |
| Vanadium | up to 1.7 |
| Columbium | up to 0.45 |
| Iron | Balance |

with the sum of manganese plus chromium exceeding 24 but being less than 31.5.

It has been discovered in arriving at this invention that the chromium content in this alloy is critical in controlling stress-corrosion cracking. At chromium contents slightly higher than 6% by weight (e.g., 6.25 or 6.5%), there is a dramatic and unexpected increase in resistance to stress corrosion cracking in cold-worked manganese-chromium-carbon austenitic steel alloys. This increase distinguishes the alloys according to this invention from prior art alloys containing at most 6% chromium.

Table I shows a group of seven alloys which partially overlaps my Cr range of >6 to <10%, but differs in other essential aspects. For example, Leitner's alloy (Item 18) is limited to fusion welded articles containing in part 3–27% Ni and <0.3% C. The high Ni and low C would produce an unacceptably low cold-work hardening rate, so that high strength retaining rings or other like articles could not be fabricated. Cihal and Poboril (Item 19) describe an alloy designed for high temperature service in which the level of 0.13% C and 0.04% would again be entirely too low for the same reason as given above. Clarke's alloys (Item 20, Table I) contain 0.15–0.35% P as an alloying addition, whereas, in alloys according to this invention, P is an impurity limited to <0.08%. Also, the presence of 4 to 10% Ni Clarke's alloys would decrease the work hardening rate to too low a level. Dyrakacz's alloys (Item 21) contain only 8–15% Mn. It has been found that low Mn detracts from stress-corrosion resistance of alloys slack quenched and then cold worked, so a minimum of 17% Mn is required. Heger's levels (Item 62) of Cr and Ni are extremely broad and the Mn is regulated only to provide an austenitic structure. The Mn in Prause's alloys (Item 63) exceeds the limit of 23% and the (C+N) is too low to provide adequate work hardening.

It has been found that although stress-corrosion resistance of small water quenched and cold worked samples is good at levels of 10–15 Cr in an alloy with, for example, 18 Mn, 0.4 Si and 0.5 C; these alloys encounter difficulties at slower cooling rates, as could be encountered during quenching of large forgings. The Mn level must be raised above 18% and the Cr level decreased below 10%. Another disadvantage of Cr contents of 10% and above is that tensile ductility and impact strength of cold worked alloys are impaired. Alloy cost is also increased and segregation could become more of a problem. The Cr content of alloys according to this invention is restricted to >6% and <10%.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which.

DESCRIPTION OF THE PREFERRED EMBODIMENT

Figure 1:
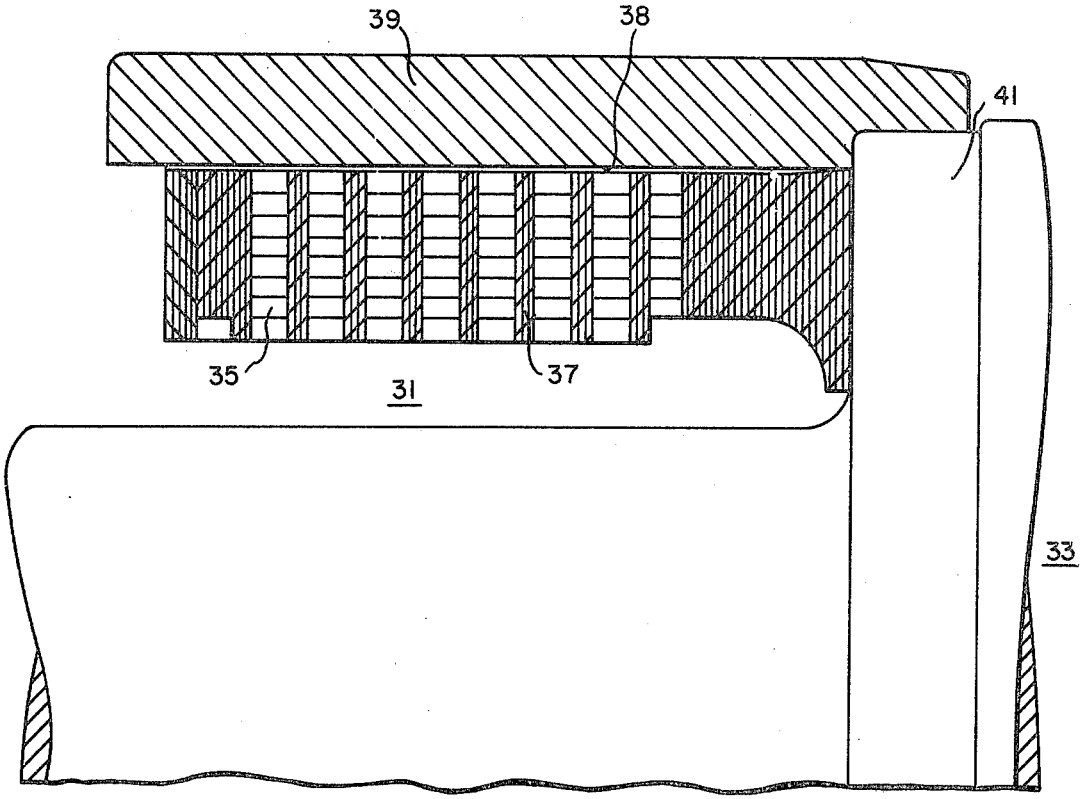
FIG. 1 is a fragmental view partly in longitudinal section of a rotor of a large high-power generator whose parts are composed of the alloy according to this invention.

The apparatus shown in FIG. 1 is the end 31 of a rotor 33 of a large generator. The rotor 33 is a single large forging and includes conductors 35 which constitute the end turns of the field windings and which emerge from the slots (not shown) to join circumferential arc portions of the windings. The conductors 35 are separated from each other and from contact with the retaining ring by insulating spacers 37 and 38. The conductors 35 are retained against the centrifugal forces acting on them by a retaining ring 39 which is shrunk onto a fit 41 of the body of the rotor 33. The ring 39 must be of high strength and is cold worked for this purpose. The ring 39 must also be non-magnetic and must have a high resistance to stress-corrosion cracking and to hydrogen embrittlement. In the practice of this invention this ring 39 is composed of the alloys according to this invention.

Figure 2:
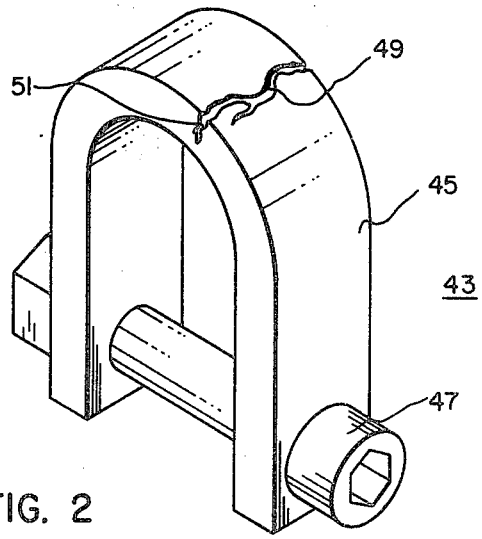
FIG. 2 is a view in perspective of a U-bend specimen used in evaluating alloys in arriving at this invention.

In arriving at this invention alloys were tested using a U-bend specimen 43 as shown in FIG. 2.

U-bend specimens 43 of the different alloys for screening of the effects of composition on stress-corrosion cracking were prepared typically in the following way: Fifty-gram pressed charges of each alloy evaluated were arc melted in argon in a button furnace in a water-cooled copper mold and then levitation melted in argon and cast as typically $\frac{1}{4}$ in. × 1 in. × $1\frac{1}{4}$ in. slabs in copper molds. These miniature ingots were homogenized, hot rolled and then solution-treated 1 hour at 1900° F (1038° C).

Strips after solution-treatment were either water quenched or cooled through the carbide precipitation range of 1500° to 1000° F (816° to 538° C) at a rate of 0.3° F/sec (0.2° C/sec). The slow cooling rate was included in the evaluation to determine the effect of sensitization on stress-corrosion cracking of the various alloys, and to provide an indication of what the consequences would be if a large part were treated or if a retaining ring received a poor quench.

Finally, the strips were cold rolled to 30% reduction of area to produce a cold-worked strip of high hardness. After grinding of the surfaces, the 0.070 in. × $\frac{1}{2}$ in. × $3\frac{3}{4}$ in. strips which resulted were bent around a 1 in. diameter mandrel in a jig to form a U-bend. The resulting U-bend was a strong spring and the ends of the U-bend 45 were held from springing back by a bolt 47. The outer fiber stress exceeded the yield strength. The bolt was electrically insulated from the specimen to avoid galvanic corrosion effects.

Under sufficient stress and after elapse of sufficient time, the U-bend 45 may develop a crack 49 which extends across the apex of the U and penetrates to a depth 51 of about 90% of the thickness. In some cases the crack 49 slowly grows so deep that the U-bend 43 snaps open under the spring tension of its arms. In other cases, after a small crack forms, it may grow catastrophically to failure. It is this latter type of behavior which must be avoided in parts in service.

Cracking of U-bends of susceptible alloys occurs at room temperature even in distilled water, although the rate is accelerated in solutions containing, for example, fluoride, chloride, iodide, bromide, nitrate or bicarbonate additions. Specimens were tested in 0.17% $KHCO_3$ in distilled water for the initial screening. Specimens which did not fail in 500 hours were transferred to a solution of 3.5% NaCl. Failure time given in the graphs (FIGS. 5–22) and Tables II, V and VI is the total time under test required for cracking to initiate and propagate across the full width and through 90% of the thickness of the bend specimen. The stress and electrolytes used for the stress-corrosion test are more severe than a retaining ring would normally be exposed to in service. The failure times, therefore, do not correspond to service lives, but are only used to judge the relative merits of different alloys.

Figure 3:
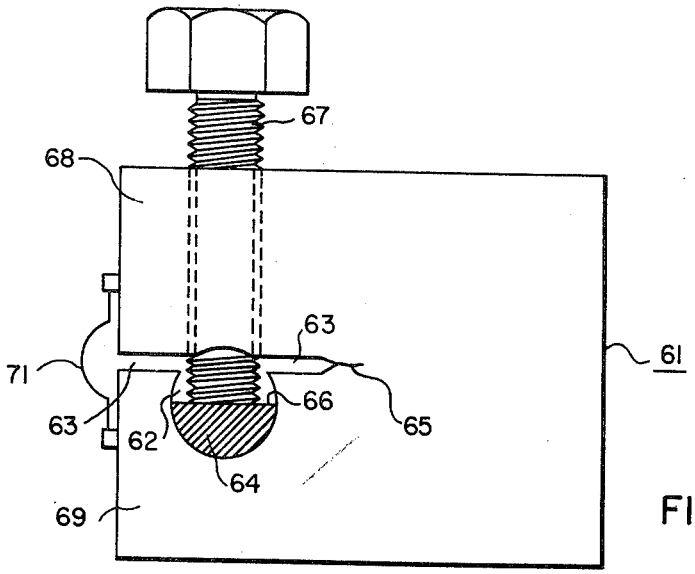
FIG. 3 is a view in side elevation, generally diagrammatic, of a wedge-opening-loading (WOL) test specimen used in evaluating alloys in arriving at this invention.

FIG. 3 shows the preloading of a wedge-opening-loading (WOL) specimen 61 for stress-corrosion susceptibility tests. The specimen 61 has a hole 62. A block 64 in the form of segment of a cylinder is placed on the lower boundary of the hole. The block terminates in a flat surface 66. The slot 63 is precracked at the inner end by fatigue loading at a low stress intensity range ($\Delta K$). A sharp crack 65 is thus developed. The specimen 61 is preloaded to a given stress intensity level ($K_i$) by a bolt 67 having a flat end. The bolt 67 screws into the upper jaw 68 of the specimen 61 with its flat end abutting the surface 66. The jaws 68 and 69 of the specimen 61 are thus forced apart to the extent desired. A clip gauge 71 measures the displacement which is a measure of $K_i$.

Figure 4:
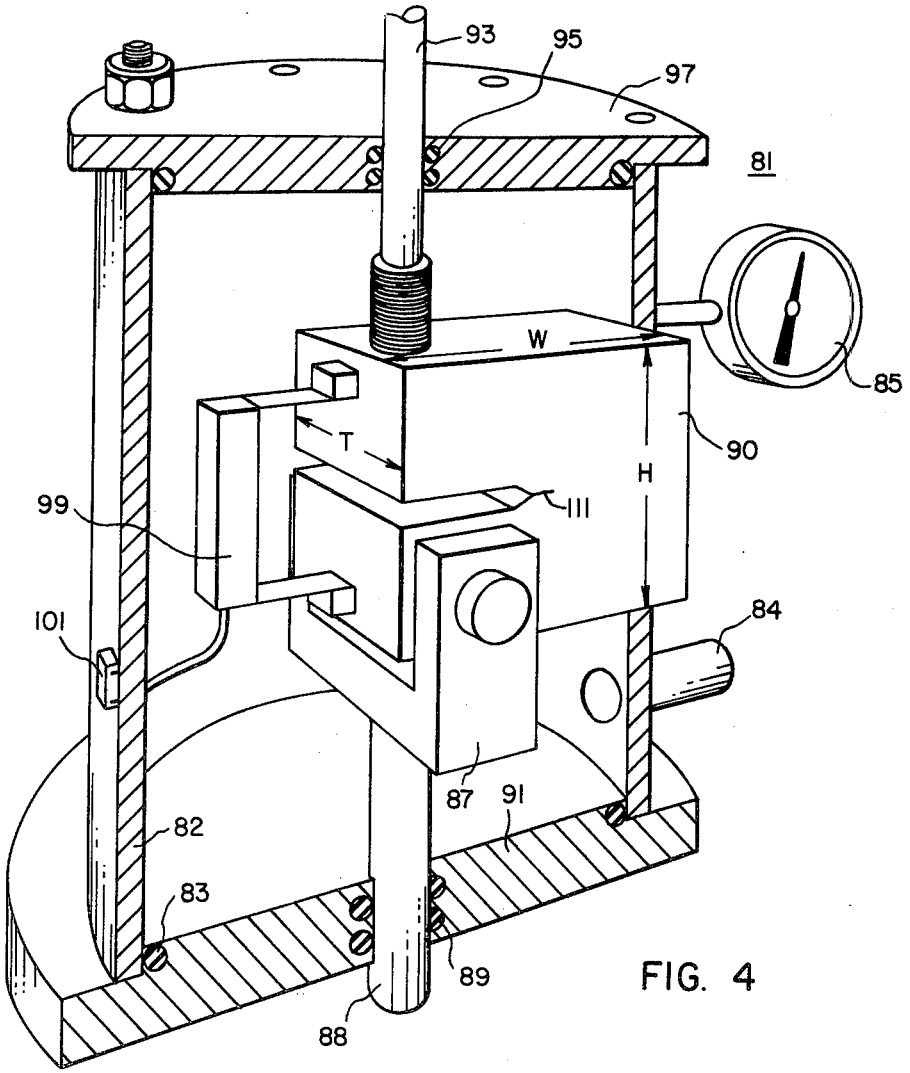
FIG. 4 is a view in perspective, partly in longitudinal section, showing apparatus for conducting stress-corrosion resistance tests while loading a specimen at a low rate in evaluating alloys in arriving at this invention.

The apparatus shown in FIG. 4 serves for conducting slow loading rate $K_{ISCC}$ tests. This apparatus has a chamber 81 which is sealed vacuum tight by O-rings 83 at the joints of its walls 82 and top 97 and base 91. The chamber 81 has an inlet 84 for gas to produce the corrosion (or embrittlement) and is provided with a pressure gauge 85 for measuring the pressure of the gas. A precracked specimen 90 generally similar to the specimen 61 shown in FIG. 3 is mounted in the chamber on bracket 87 on a rod 88 which passes through an O-ring seal 89 in the base 91. A threaded rod 93 which enters the chamber through an O-ring seal 95 in the top 97 is screwed into the top of the specimen 90. There is a clip gauge 99 for measuring the displacement. The gauge 99 is connected to an output terminal 101. The specimen 90 is loaded by applying tension between the rods 88 and 93.

Figure 5:
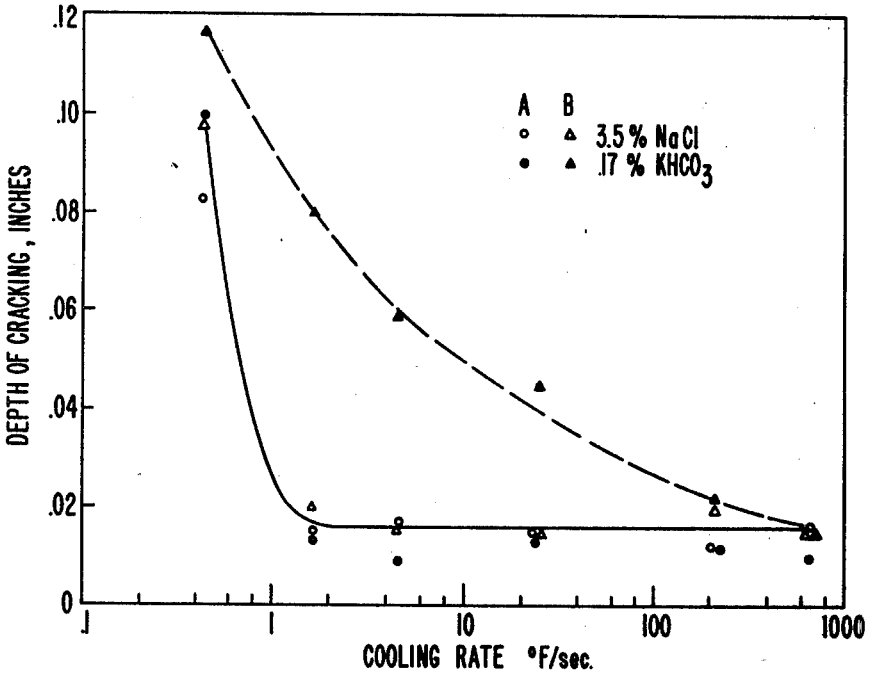
FIG. 5 is a graph showing the effect, on stress-corrosion cracking, of cooling rate after solution treatment of an alloy.

To demonstrate the effect of cooling rate from the solution temperature on stress-corrosion cracking, strips rolled from two commercial heats of prior art 18 Mn-5 Cr-0.5 C steel used for baffle rings were solution treated one hour at 1900° F (1038° C) and cooled at six different rates. After cold rolling with 29% reduction of area, stress-corrosion tests of ⅛ in. thick U-bend specimens as shown in FIG. 2 were run in a 0.17% $KHCO_3$ solution in distilled water for 7 days and another group in a 3.5% NaCl solution for 7 days. FIG. 5 is a plot of the depth of cracking for the two alloys in both solutions as a function of cooling rate from 1400° to 1000° F (760° to 538° C) in ° F/sec. FIG. 5 shows that in NaCl the cracking was unchanged until the slowest rate was reached. In $KHCO_3$, material A behaves in the same way, but material B has a continuous increase of cracking as the cooling rate decreases. It is therefore clear that, with the cooling rates attainable in the center of retaining rings, some heats of 18 Mn-5 Cr-0.5 C steel may undergo sufficient precipitation to be highly susceptible to stress-corrosion cracking. It is therefore an important objective of this invention to provide alloys that have improved resistance to stress-corrosion cracking, even if heavy sections of the material receive a slack quench.

The following Table II tabulates the results of tests with U-bend specimens (43 FIG. 2) of prior art compositions and representative compositions in accordance with this invention.

TABLE II

Failure Times of U-Bends of Cold Worked Mn-Cr Austenitic Steels in a Stress-Corrosion Test*  *

| Alloy No. | Mn | Cr | Ni | Mo | V | Cb | Si | C | N | Water Quenched DPH | Water Quenched Hours | 0.3° F/sec Furnace Cool DPH | 0.3° F/sec Furnace Cool Hours |
|---|---|---|---|---|---|---|---|---|---|---|---|---|---|
| 54 | 18 | 5 | | | | | .4 | .5 | | 413 | 7.2 | 415 | 3.3 |
| 102 | 18 | 5 | | 1.5 | | | .4 | .5 | | 449 | 100 | 422 | 90 |
| 47 | 18 | 5 | | 3 | .8 | | .4 | .5 | | 398 | 40 | 432 | 40 |
| 219 | 18 | 5 | | | | .4 | .4 | .55 | .1 | 441 | 3.5 | 449 | 4.5 |
| Simple Alloys of Invention | | | | | | | | | | | | | |
| 257 | 18.5 | | 6.5 | | | | .4 | .5 | | 415 | 694 | 411 | 29 |
| 135 | 20 | | 9 | | | | .4 | .5 | | 406 | 1750 | 415 | |
| 134 | 19.5 | | 7.5 | | | | .4 | .5 | | 422 | 1175 | 415 | 4 |
| 152 | 17 | | 8 | | | | .4 | .5 | | 406 | 565 | 425 | 1.7 |
| 124 | 22 | | 8 | | | | .4 | .5 | | 406 | 2740+ | 418 | 16 |
| 216 | 20 | | 7 | | | | .4 | .5 | | 436 | 764 | 418 | 65 |
| 62 | 18 | | 8 | | | | .4 | .5 | | 441 | 482 | 415 | 5.5 |
| 468 | 23 | | 7 | | | | .4 | .5 | | 406 | 4415+ | 425 | 50 |
| 131 | 19 | | 7 | | | | .4 | .5 | | 411 | 1300 | 418 | 10 |
| Preferred Alloys of Invention with Additions of Ni, Mo, V, Cb and N | | | | | | | | | | | | | |
| 247 | 19 | 7 | | 1.0 | | | .4 | .5 | | 432 | 885 | 391 | 635 |
| 238 | 18 | 8 | | | | | .4 | | .7 | 410 | 4200+ | 377 | 4080+ |
| 236 | 20 | 7 | | | | | .4 | | .7 | 400 | 4200+ | 393 | 4080+ |
| 226 | 22 | 8 | .5 | | | .4 | .4 | .55 | .1 | 413 | 4200+ | 427 | 765 |
| 224 | 20 | 7 | .5 | | | .4 | .4 | .55 | .1 | 400 | 1534 | 434 | 960 |
| 431 | 19 | 7 | | | | .2 | .4 | .55 | .1 | 454 | 1275 | 439 | 645 |
| 165 | 18 | 8 | 2 | | | | .4 | .5 | | 393 | 4130+ | 373 | 672 |
| 217 | 20 | 7 | .5 | | | | .4 | .5 | | 439 | 1100 | 406 | 630 |
| 251 | 20 | 7 | .5 | .6 | | | .4 | .5 | | 377 | 1246 | 400 | 408 |
| 324 | 19 | 7 | 1 | 1.5 | .8 | | .4 | .5 | | 429 | 1050 | 429 | 1030 |
| 252 | 19 | 7 | | 3 | .8 | | .4 | .5 | | 420 | 4200+ | 429 | 698 |

TABLE II-continued

Failure Times of U-Bends of Cold Worked Mn-Cr Austenitic Steels in a Stress-Corrosion Test*  *

| Alloy No. | Mn | Cr | Ni | Mo | V | Cb | Si | C | N | Water Quenched DPH | Water Quenched Hours | 0.3° F/sec Furnace Cool DPH | 0.3° F/sec Furnace Cool Hours |
|---|---|---|---|---|---|---|---|---|---|---|---|---|---|
| 253 | 19 | 7 | .5 | 3 | .8 | | .4 | .5 | | 393 | 4200+ | 441 | 650 |
| 65 | 18 | 8 | .5 | 3 | .8 | | .4 | .5 | | 446 | 1460 | 404 | 620 |
| 177 | 18 | 8 | .5 | 1.5 | .8 | | .4 | .5 | | 413 | 4130+ | 400 | 672 |
| 178 | 18 | 8 | .5 | 1.5 | 1.5 | | .4 | .5 | | 434 | 4130+ | 434 | 768 |
| 280 | 22 | 8 | .5 | 1.5 | .8 | | .4 | .5 | | 373 | 4200+ | 429 | 635 |
| 297 | 19 | 7 | .5 | 1.5 | 1.5 | | .4 | .5 | | 429 | 4200+ | 444 | 635 |
| 298 | 19 | 7 | .5 | .6 | | | .4 | .4 | .2 | 387 | 1870 | 391 | 1006 |
| 317 | 19 | 7 | .5 | | .8 | | .4 | .5 | | 457 | 790 | 465 | 590 |
| 394 | 18 | 8 | .5 | 1.5 | .8 | | .4 | | .7 | 409 | 5590+ | 422 | 5590+ |
| 388 | 17 | 9 | | | | | .4 | | .7 | 396 | 810 | 398 | 5590+ |
| 393 | 19 | 7 | .5 | .8 | | | .4 | .2 | .4 | 398 | 3673 | 411 | 5590+ |
| 474 | 18 | 8 | .5 | | .8 | | .4 | .5 | | 422 | 4415+ | 429 | 561 |
| 241 | 18 | 8 | 2 | | | | .4 | .7 | | 370 | 4200+ | 402 | 72 |

*Up to 550 hours in 0.17% $KHCO_3$ in distilled water and then transferred to a solution of 3.5% NaCl.
**Balance essentially iron.
***Nominal content in weight percent - requested analyses.

In this table the first column presents the alloy numbers, the next 9, the nominal composition of each alloy, the 11th and 12th, diamond-pyramid-hardness (DPH), and failure times in hours for water quenched specimens and the 13th and 14th, DPH and failure times for slowly cooled (0.3° F/sec) specimens.

Based on Table II, the effects of composition on stress-corrosion cracking of U-bends of cold worked Mn-Cr alloys in potassium bicarbonate and sodium chloride may be summarized as follows. The conventional retaining ring alloy, 18 Mn-5 Cr-0.5 C, has short failure times in both the water quenched and slow cooled condition. Additions of Mo or Mo + V are helpful, but not sufficiently so for service in hostile environments. Cb had no effect.

The second group of nine alloys in Table II represents simple alloys falling within the scope of this invention. Within the broad range 17–23% Mn and >6 to <10% Cr, rapidly cooled material has remarkably improved resistance to stress-corrosion cracking. Members of small cross-section, or moderate sections of these compositions, if they were drastically quenched, would have excellent resistance to stress-corrosion cracking. However, heavier sections and members not adequately quenched, because of lack of shop control or lack of proper equipment, could still be susceptible to stress-corrosion cracking. For critical applications, such as retaining or baffle rings for large electric generators, it is preferable to add one or more elements from the class consisting of Ni, Mo, V, Cb and N. The last group, of twenty-four alloys in Table II, represents some typical compositions falling within the scope of this invention. It will be noted that these alloys are characterized by having good stress-corrosion resistance in both the quenched and slow-cooled condition and an adequate rate of work hardening during cold deformation.

The data tabulated in Table II represents only a few of the odd 1000 tests on 500 alloy compositions which were conducted in arriving at this invention. The remaining pertinent data from the 1000 odd tests are plotted in FIGS. 6 through 24. In FIGS. 6 through 24 the actual points, derived from the tests, on which the graphs are based are shown. The labels near the lower left-hand corners of the graphs of FIGS. 14, 15, 16 and 17 show the components in weight percent of the alloys, other than the balance of iron, and the component, whose weight percent is being varied. The graphs therefore present the compositions of the alloys corresponding to each point. For example, the solid point on the extreme right of FIG. 6, corresponding to a time-of-failure of about 500 hours, is plotted for an alloy having the following composition in weight percent:

| | |
|---|---|
| Mn | 18 |
| C | 0.5 |
| Si | 0.4 |
| Cr | 19 |
| Fe | Balance |

Figure 6:
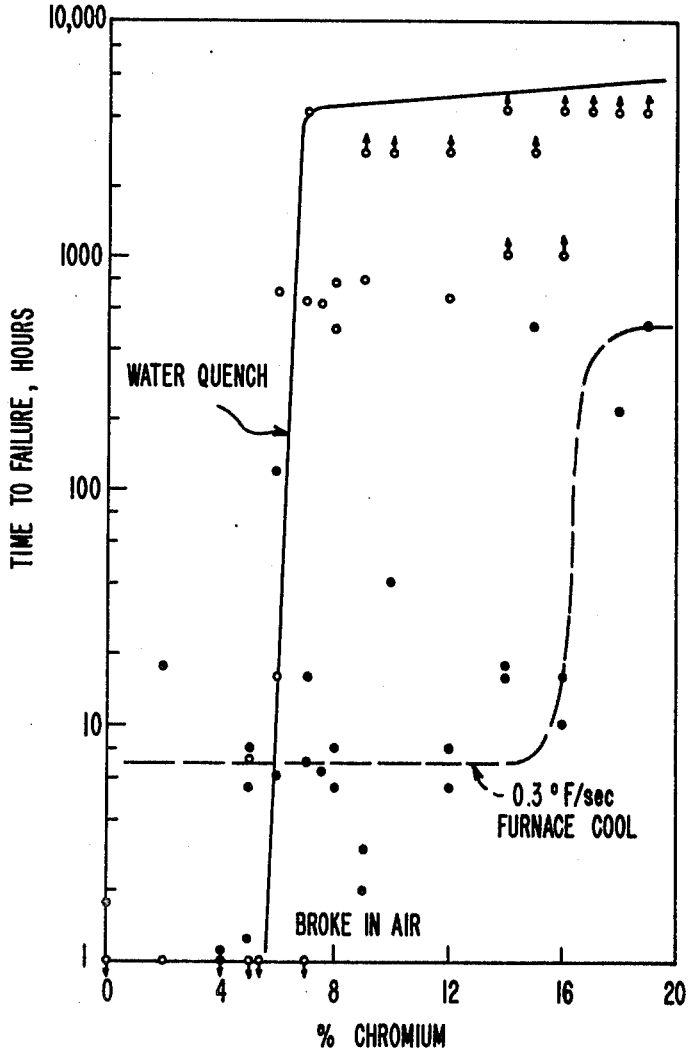
FIGS. 6 and 7 are graphs showing the effects on stress-corrosion cracking and hardness and structure of different contents of chromium in 18 Mn-0.5 C-0.4 Si ferrous alloys.
Figure 8:
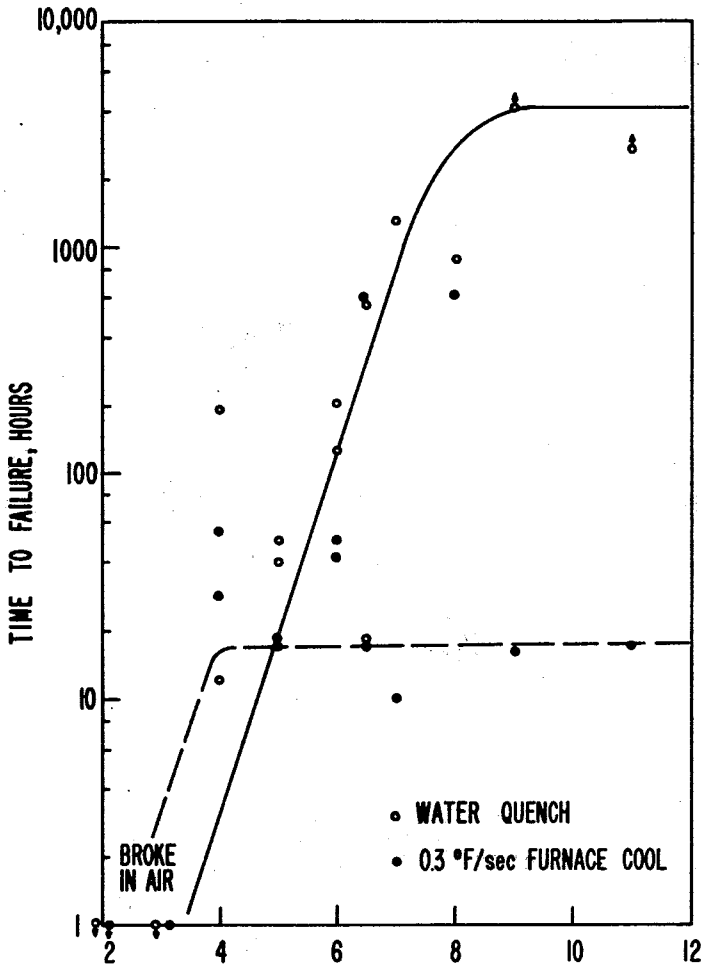
FIGS. 8 and 9 are similar graphs for 19 Mn-0.5 C-0.4 Si ferrous alloys.
Figure 7:
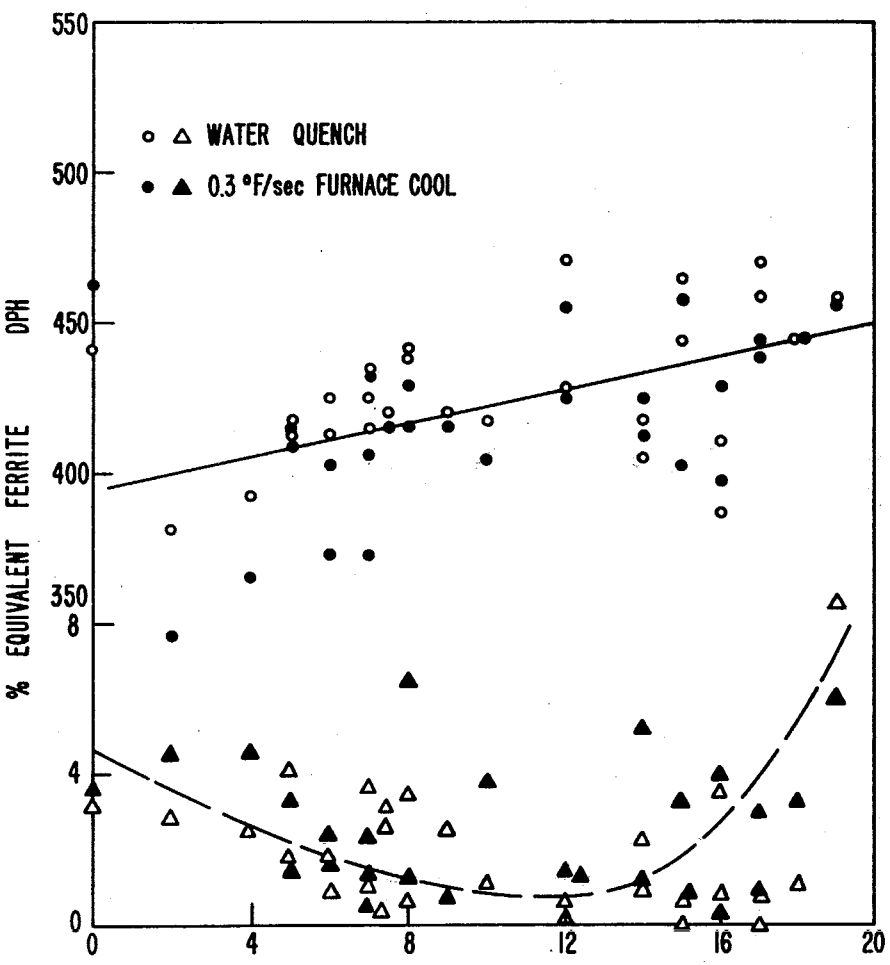
Figure 10:
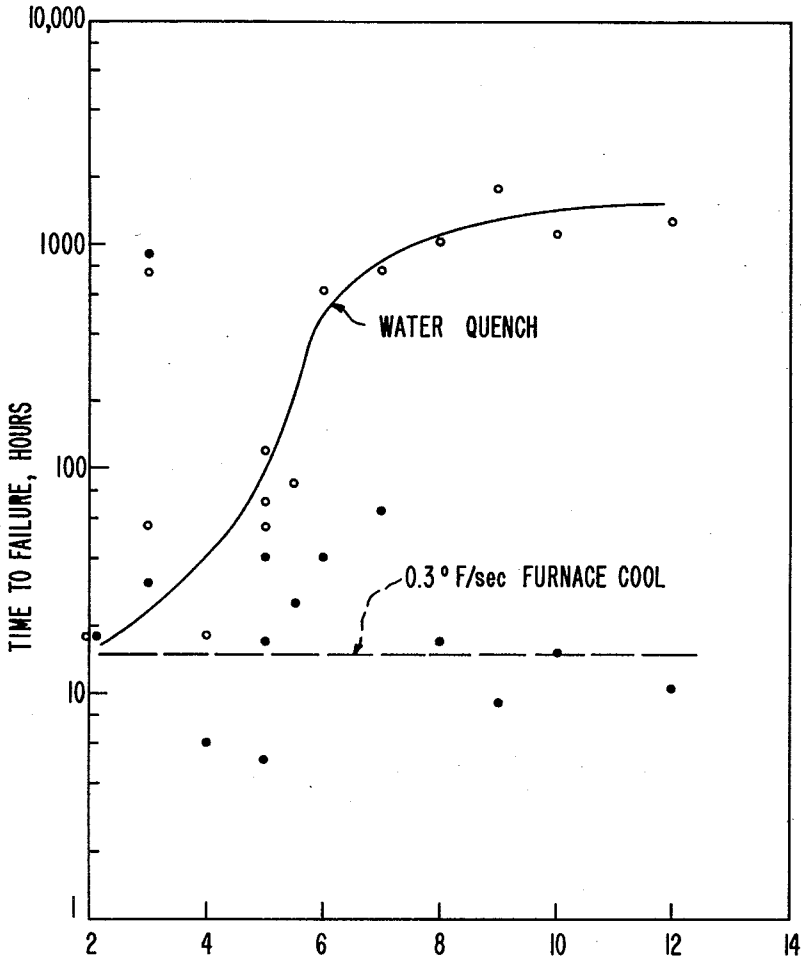
FIGS. 10 and 11 are similar graphs for 20 Mn-0.5 C-0.4 Si ferrous alloys.
Figure 9:
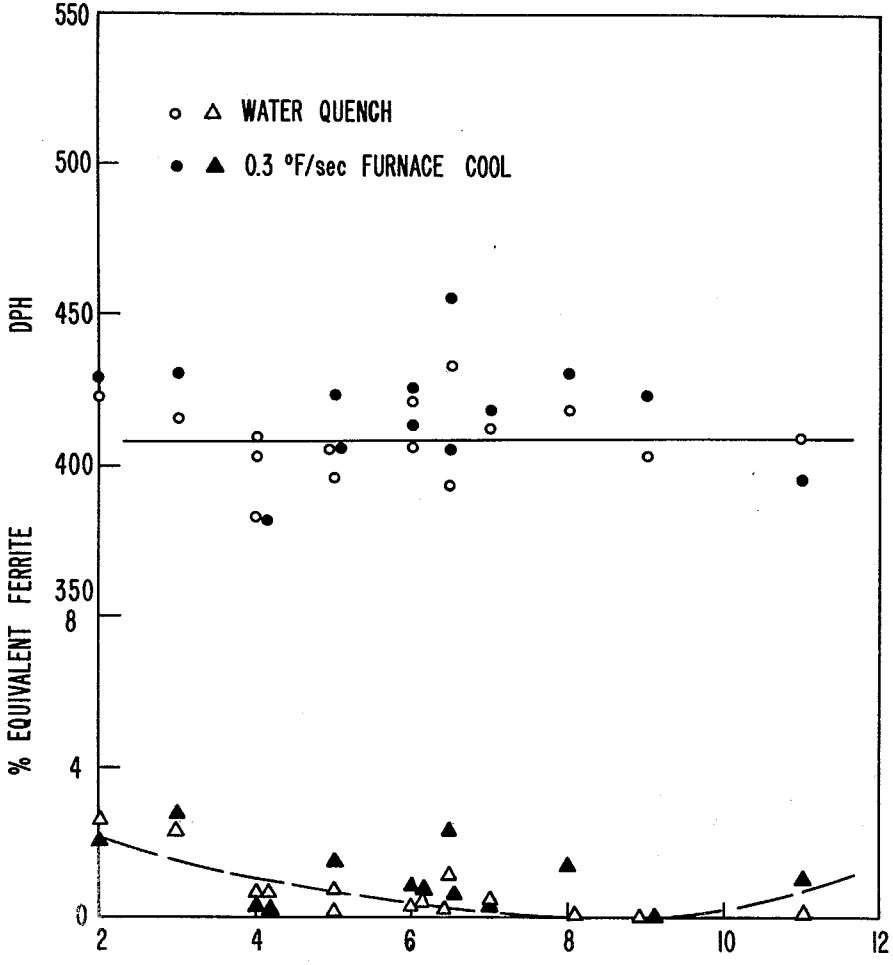

The graphs together with their labels and the short description of their Figures speak for themselves. For example, FIG. 6 presents graphically the time-of-failure, plotted on a logarithmic scale as the ordinate, as a function of chromium content in weight percent, plotted on the abscissa, for alloys whose basic composition is 18 Mn-0.5 C-0.4 Si-Fe. The full-line curve is for the alloys water quenched (rapid quench) from the solution temperature, and the broken line curve is for the alloys cooled at the rate of 0.3° F per second. FIG. 7, upper curve, plots the hardness in DPH (diamond pyramid hardness) as a function of chromium content for the same alloys and FIG. 7, lower curve, plots equivalent ferrite content (delta ferrite or martensite) in weight percent as a function of the chromium content.

Based on FIGS. 6 through 24 and Table II, the following conclusions are reached, in arriving at the invention, as to the functions of the major alloying components of the alloys:

CHROMIUM

Figure 14:
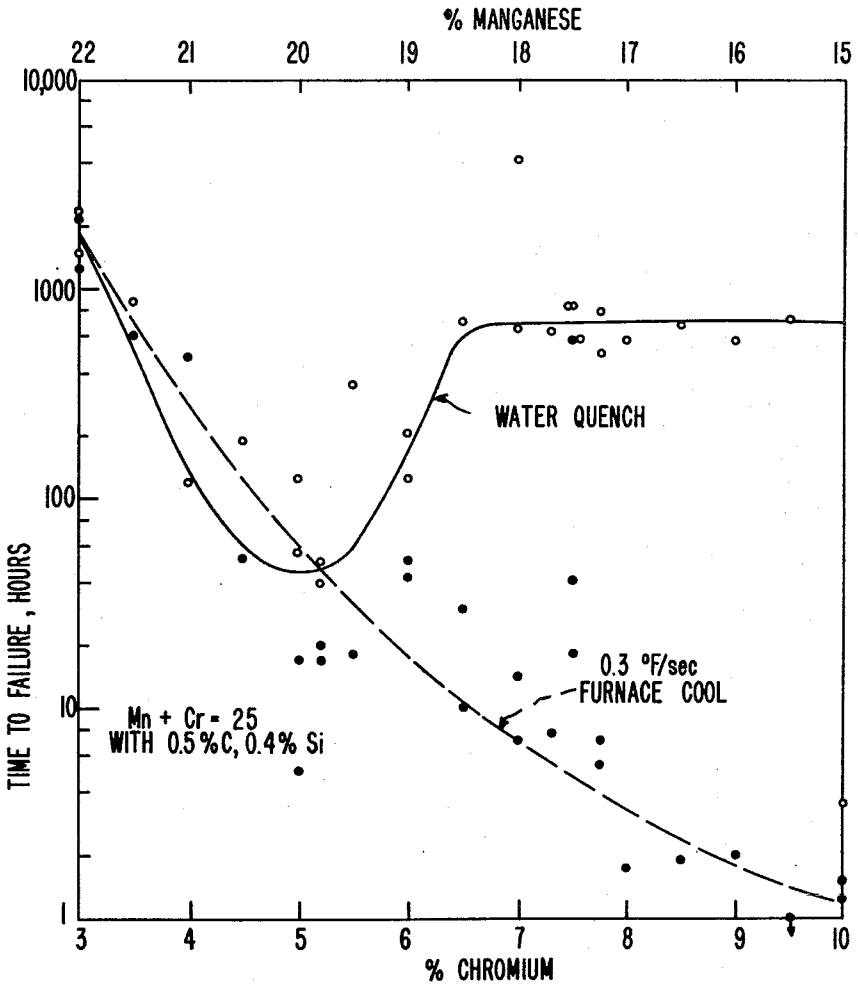
FIGS. 14 and 15 are graphs showing the effects, on stress-corrosion cracking and hardness and structure, of changing the ratio of Cr to Mn with (Mn + Cr) = 25% in Mn - Cr -0.5% C, 0.4% Si ferrous alloys.
Figure 13:
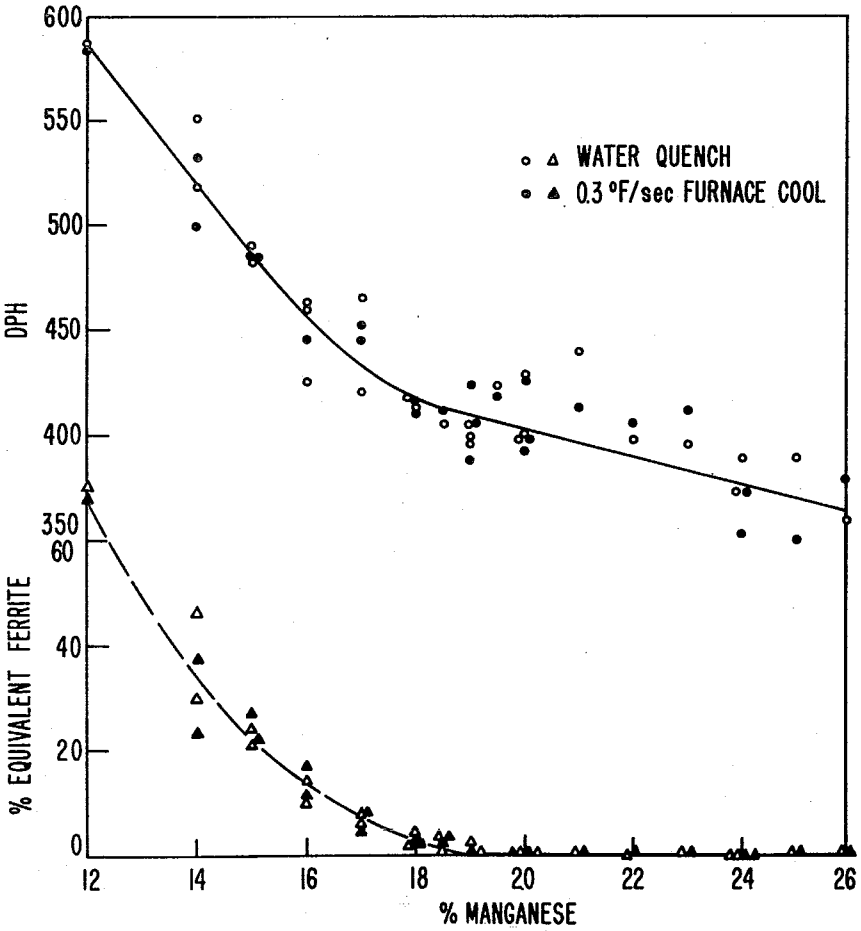
Figure 16:
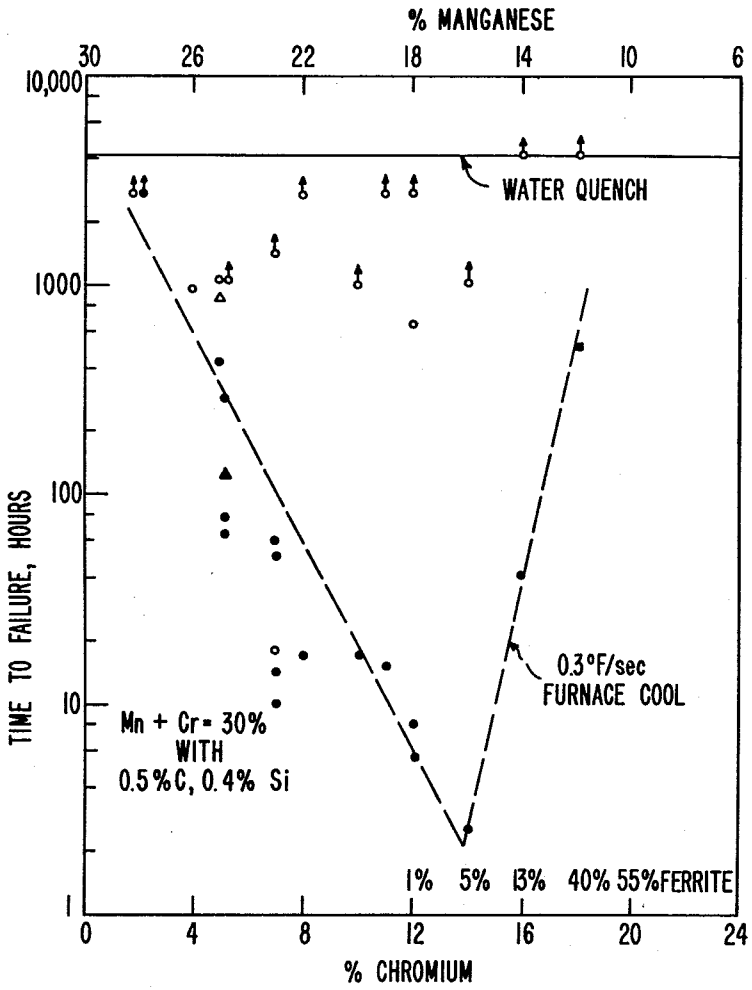
FIGS. 16 and 17 are similar graphs in which (Mn + Cr) is 30%.

Chromium has a remarkable effect on stress-corrosion cracking of cold worked, austenitic 18% Mn-0.5% C alloys. As shown in FIG. 6, just above 6% Cr, for example at 6.25 or 6.50%, there is a discontinuous and manyfold increase in time to failure of water quenched specimens. The top of the range for chromium for current retaining ring alloys is 6%. Higher Cr also increases the rate of work hardening. On the other hand, if Cr is greater than 10%, the tensile ductility and impact energy of the alloy are decreased. Depending on the level of other elements, Cr below 6% can raise $M_d$ (the temperature at which martensite will form if the material is deformed) above room temperature so that $\alpha'$ martensite forms on cold working; or Cr> 12% can lead to the formation of delta ferrite. Either martensite or delta ferrite are ferromagnetic and would impair the non-magnetic characteristics of a retaining ring. In slow-cooled specimens, stress-corrosion resistance is poor and high Cr is actually detrimental if Mn >18% (FIGS. 14 and 16).

In more complex alloys containing beneficial additions of Ni, Mo and V, as will now be described, Cr has an important effect on bend ductility. This property is related to the ability of the alloy to withstand the severe cold expansion used to attain the desired yield strength in a retaining ring. For example, four experimental alloys, which were prepared as described previously, had the following nominal compositions in weight percent:

| Alloy No. | Mn | cr | Ni | C | Si | Mo | V | Fe |
|---|---|---|---|---|---|---|---|---|
| 451 | 17 | 9 | .5 | .5 | .4 | 1.5 | .8 | Bal |
| 452 | 16 | 10 | .5 | .5 | .4 | 1.5 | .8 | " |
| 445 | 21 | 9 | .5 | .5 | .4 | 1.5 | .8 | " |
| 446 | 20 | 10 | .5 | .5 | .4 | 1.5 | .8 | " |

Hardness and failure times in U-bend stress-corrosion tests of cold worked strips were as follows:

| Alloy | % | Water Quenched | | 0.3° F/sec. Furnance Cool | |
|---|---|---|---|---|---|
| No. | Cr | DPH | Hours* | DPH | Hours* |
| 451 | 9 | 413 | 4700+ | 449 | 597 |
| 452 | 10 | 459 | 2540 | 439 | X |
| 445 | 9 | 400 | 4700+ | 396 | 640 |
| 446 | 10 | 418 | 4225 | 418 | X |

X = Broke during bending
*Hours to failure in stress-corrosion test.

In the water quenched and cold worked strips, the failure time has started to decline as Cr was increased from 9 to 10%. The most important effect observed, however, was that the strips cooled slowly from the solution temperature, and then cold worked, fractured during forming of the U-bend. The Cr in alloys according to this invention is therefore required to be less than 10%.

The broad range of Cr in the alloys according to this invention is therefore from greater than 6 to less than 10%, for example, 6.5 to 9.5%, and preferably 7 to 9%.

MANGANESE

Figure 12:
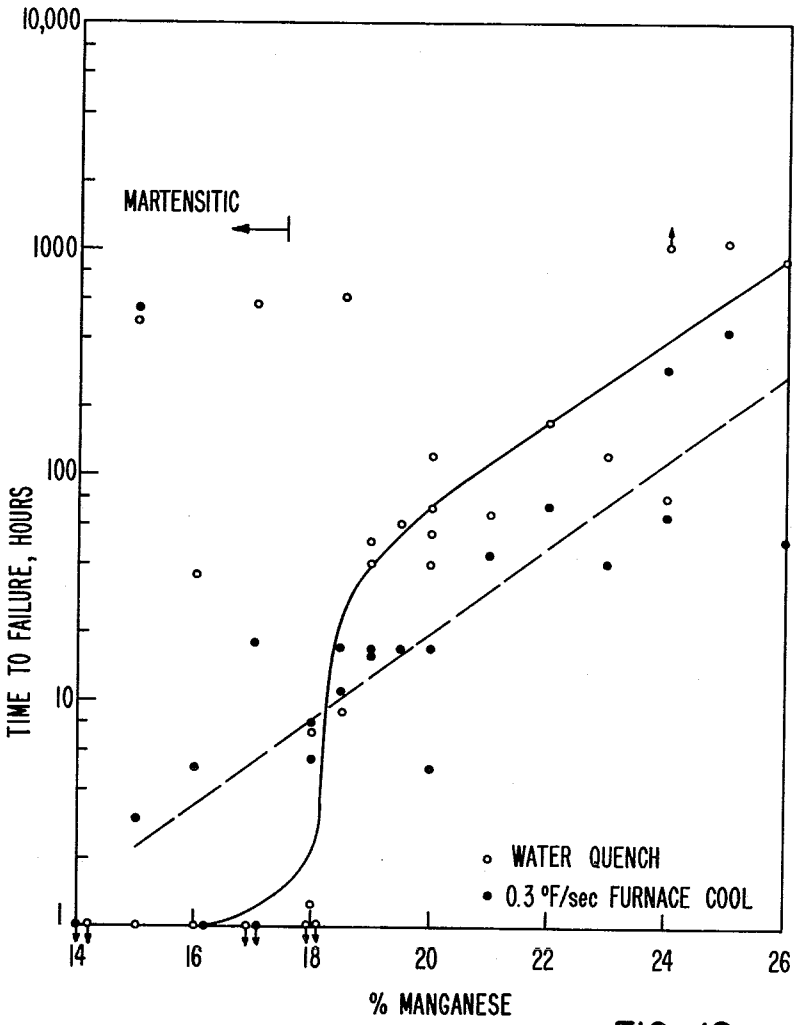
FIGS. 12 and 13 are graphs showing the effects on stress-corrosion cracking and hardness and structure, of different contents of manganese on 5 Cr-0.5 C-0.4 Si ferrous alloys.
Figure 11:
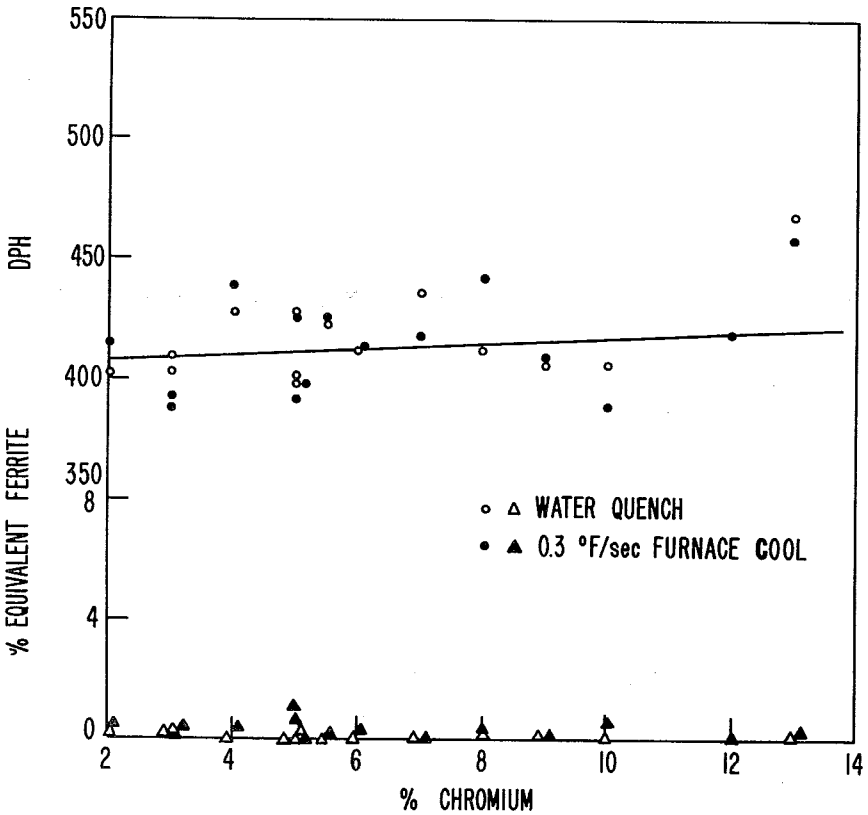

As shown in FIG. 12, resistance to stress-corrosion cracking of both water-quenched and slow-cooled specimens increases with Mn content up to as high as 26%. Mn contributes to the stability of austenite in these alloys. The increase in slope of the hardness curve in FIG. 13 below 17–18% Mn corresponds to compositions in which martensite is formed during cold working, which would make the alloys ferromagnetic. The alloy according to this invention contains 17% Mn or more. Above 17% Mn the work hardening rate decreases linearly with increased Mn and the general corrosion resistance is adversely affected if Mn exceeds 23%. The alloys of this invention are limited to 17–23% Mn and preferably to 18–22% Mn. In this composition range the alloys have a low stacking fault energy and the extensive twinning that occurs during cold working contributes to the desired high rate of work hardening. It has been found that better properties are obtained if Mn and Cr are not simultaneously at the respective low or high ends of their ranges. It is required that the sum of (Mn + Cr) be greater than 24 but less than 31.5%.

Cr/Mn RATIO

Figure 15:
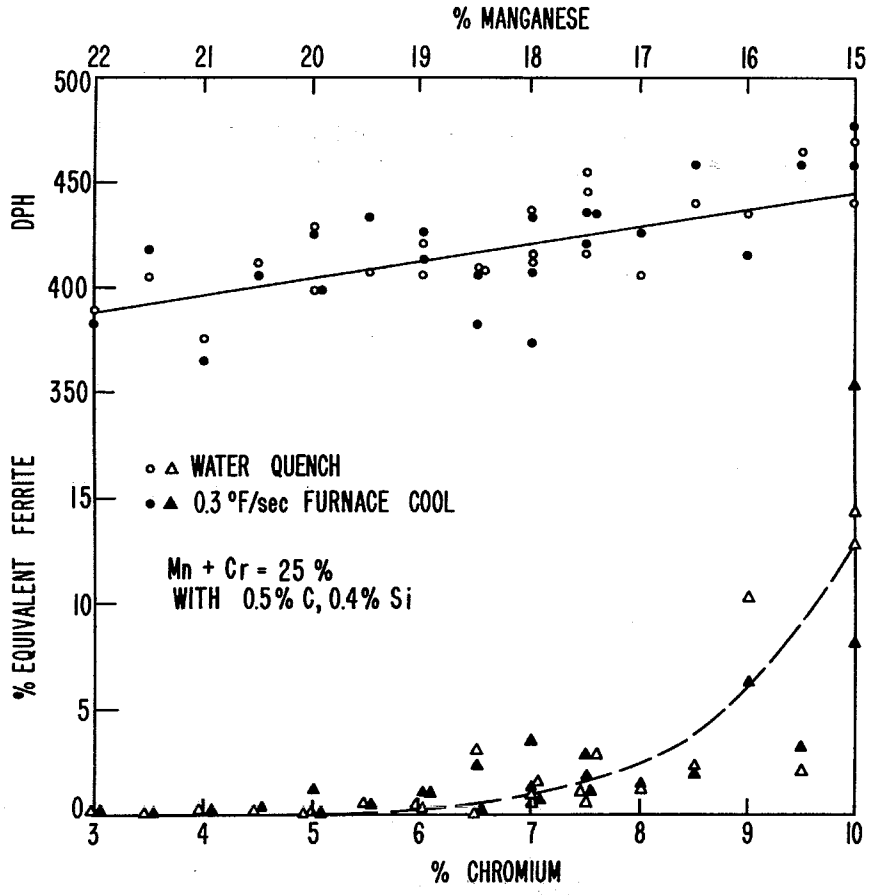

The effect of Cr/Mn ratio at a constant level of (Mn + Cr) = 25% is illustrated in FIG. 14. In water quenched samples, the high Mn low Cr alloys corrode rapidly and although cracks initiate early, they grow very slowly. Failure time is a minimum at about 5% Cr. Above 6% Cr, general corrosion resistance is improved, and stress-corrosion resistance is good up to 10% Cr. The slowly cooled samples in FIG. 14 show a progressive decrease in failure time as Cr/Mn ratio increases. Although hardness increases at the higher Cr/Mn ratios, this is counterbalanced by an increase in ferromagnetism caused by the appearance of delta ferrite, as shown in FIG. 15.

Figure 17:
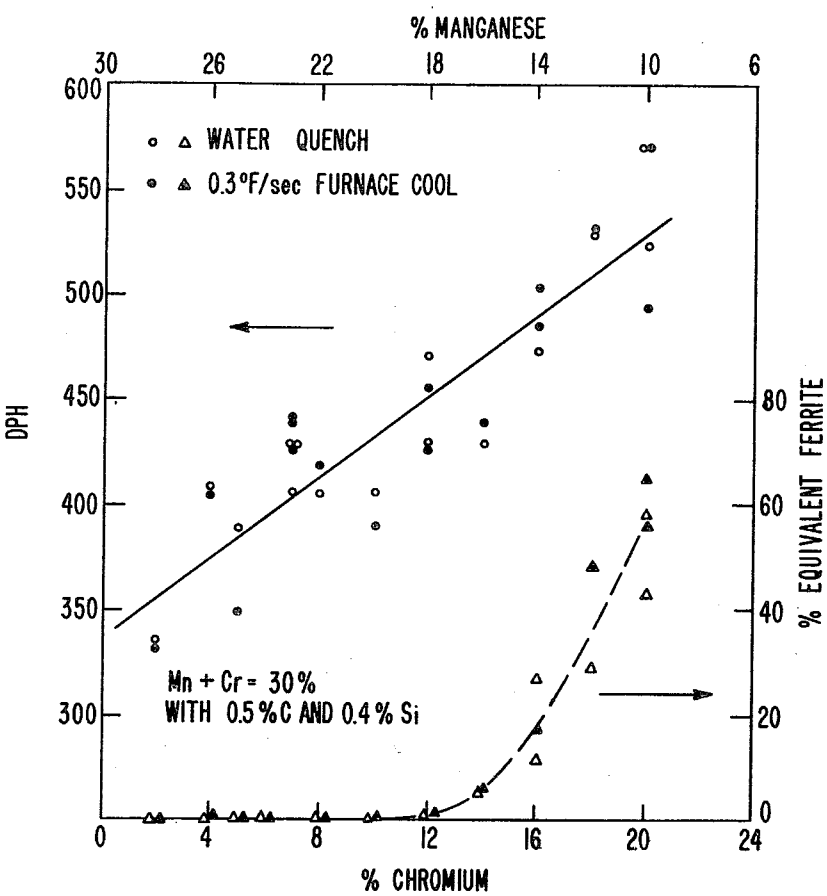

At a higher total alloy content, (Mn + Cr) = 30, the stress-corrosion resistance is excellent over the whole composition range illustrated in FIG. 16. Again the high Mn-low Cr alloys have poor general corrosion resistance and a low rate of work hardening (FIG. 17). The susceptibility to stress-corrosion cracking increases with Cr (FIG. 16) in the slow-cooled condition up to 14 Cr. Higher Cr, lower Mn alloys than this are not useful because of brittleness and an increase in ferromagnetism resulting from the presence of delta ferrite (FIG. 17).

From all of the above considerations, the Cr should be >6 and <10% for properly quenched materials, and for poorly quenched material it should be in the range of 6.5–7.5% Cr, 18.5–17.5% Mn. Such a composition is a marked improvement over the conventional 18 Mn-5 Cr alloy, but further improvement in stress-corrosion resistance of quenched alloys and especially of alloys in the slow-cooled condition is desirable. It has been discovered that this can be accomplished by additions of one or more elements from the group consisting of Ni, Mo, V, Cb and N, as will now be illustrated.

NICKEL

Nickel is a common ingredient in Cr-Mn steels of the prior art. Since Cr is a delta ferrite forming element and Mn is also a ferrie former at the levels of Mn of interest here (Document 7), high levels of austenite formers are needed to maintain a stable austenite and to avoid delta ferrite formation on solidification or during heat treatment and the formation of $\alpha'$ martensite during cold working. The most common austenite forming elements used are C, N and Ni. Levels of C and N are limited by workability considerations to a maximum of about 0.8% (C+N), and preferably less, so that any additional austenite forming potential needed is usually supplied by Ni.

Figure 18:
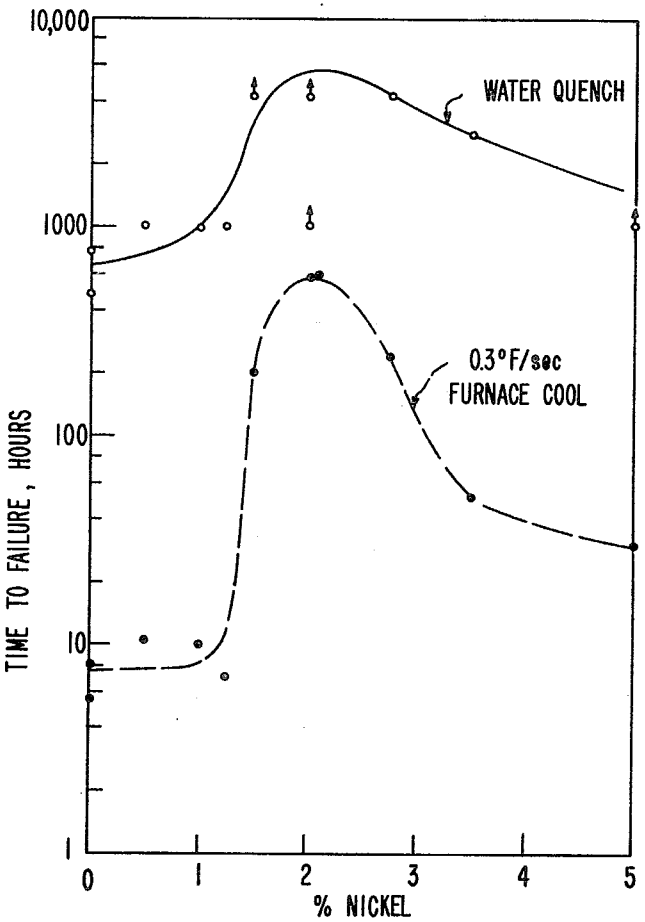
FIGS. 18 and 19 are graphs showing the effects, on stress-corrosion cracking and hardness, of different contents of nickel in 18 Mn-8 Cr-0.5 C-0.4 Si ferrous alloys.
Figure 19:
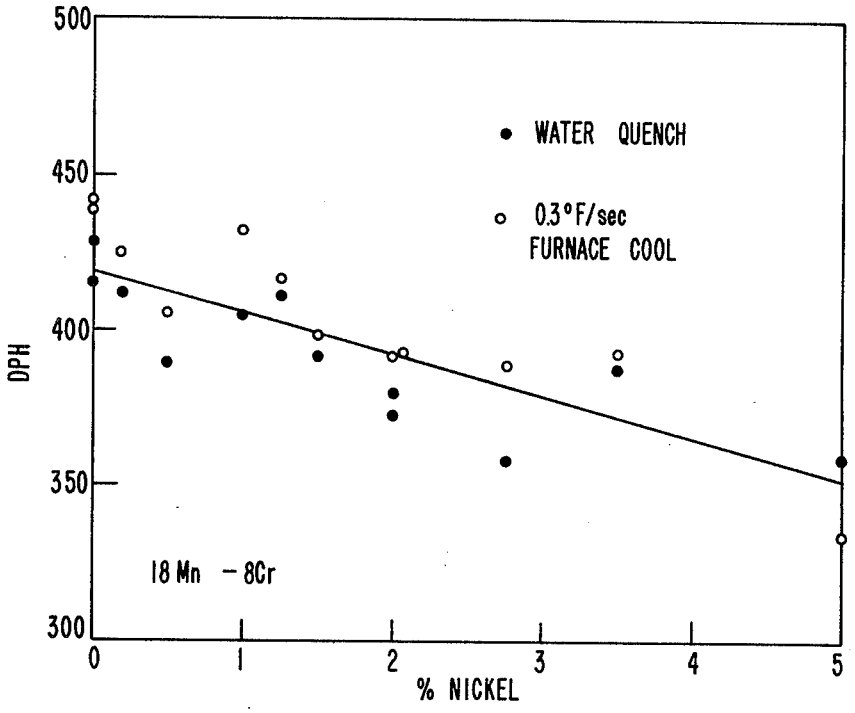

It has been found that nickel is beneficial in improving the resistance to stress-corrosion cracking of cold-worked austenitic Mn-Cr-C-Si steels. For example, in an alloy with 18 Mn-8 Cr-0.5 C-0.4 Si, in either water quenched or slowly cooled specimens, there is a maximum in the time to failure in a stress-corrosion test at about 2% Ni (FIG. 18). However, nickel has an adverse effect on the working hardening rate, approximately in proportion to the amount present, presumably because Ni increases the stacking fault energy. FIG. 19 shows that for a constant amount of cold work, hardness decreases linearly with increasing Ni. It is therefore essential that Ni be kept below about 2.75% so that the alloy can be cold worked to useful yield strength levels with a minimum amount of deformation.

Actually, the optimum nickel level must be a compromise between the opposing factors of work hardening rate and stress-corrosion cracking resistance. In the broad Ni range of 0.2–2.75%, the lower end of the range (0.2–1%) is preferred for especially high strength alloys and the upper end of the range (1–2.75%) is preferred for the optimum in stress-corrosion resistance.

SILICON

Si in the range of 0 to 1.5% was found not to have an appreciable effect on stress-corrosion cracking of these alloys. Most of the alloys contained 0.4% Si as a deoxidizing agent.

MOLYBDENUM

Figure 20:
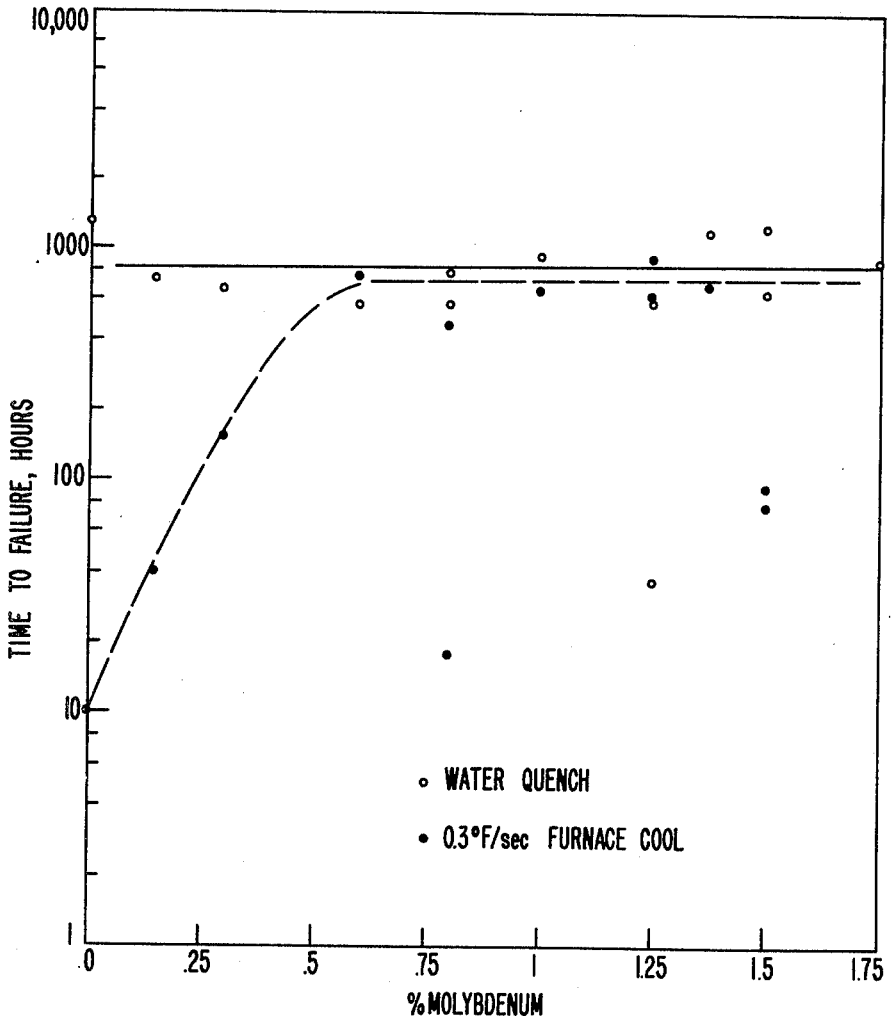
FIG. 20 is a graph showing the effect, on stress-corrosion cracking, of different contents of molybdenum on 19 Mn-7 Cr-0.5 C-0.4 Si ferrous alloys.

Molybdenum is beneficial in reducing susceptibility to stress-corrosion cracking in Mn-Cr-C-Si austenitic steels. In the standard 18 Mn-5 Cr-0.5 C-0.4Si alloy, failure times of U-bends of both water quenched and slow-cooled samples are improved substantially, but still not sufficient for the service conditions to which retaining rings may be subjected. In the alloys of this invention, such as 19 Mn-7 Cr-0.5 C-0.4 Si, the failure time of water quenched samples is long and independent of Mo, whereas in slow-cooled samples failure time increases as Mo is added up to about 0.6% and then levels off, as shown in FIG. 20.

Figure 21:
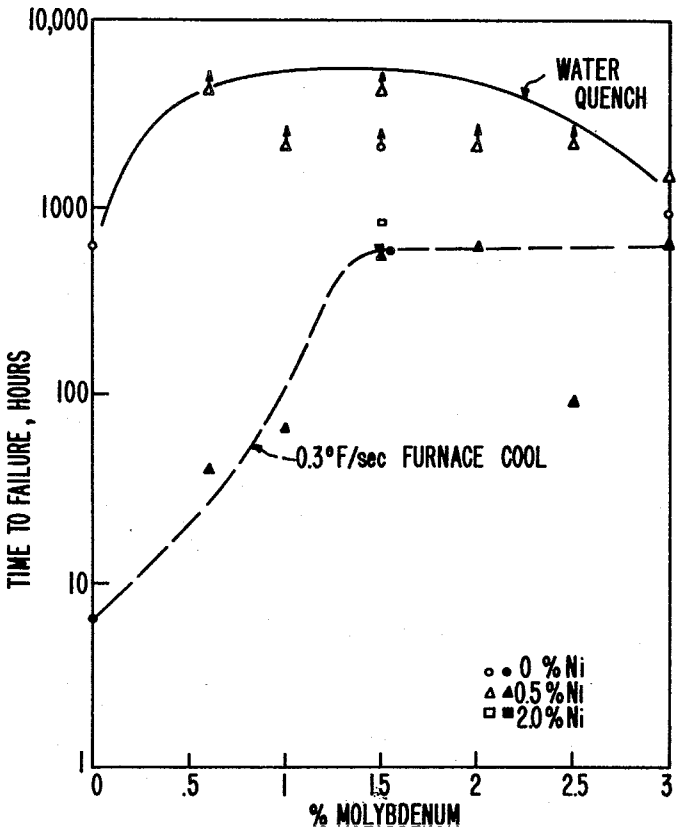
FIG. 21 is a graph showing the effect, on stress-corrosion cracking, of different contents of molybdenum on 18 Mn-8 Cr-0.5 C-0.4 Si-0.8 V ferrous alloys.
Figure 24:
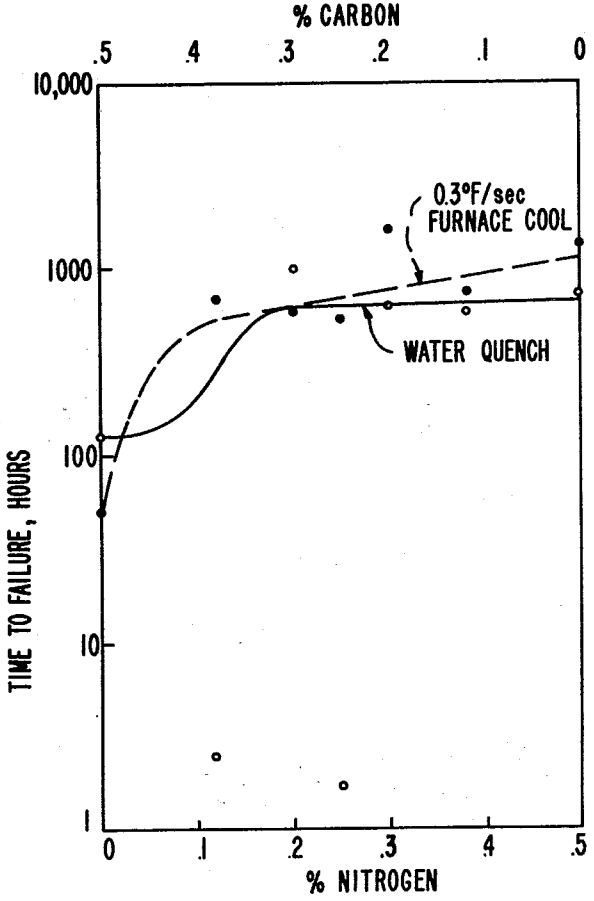
FIG. 24 is a graph showing the effect, on stress-corrosion cracking, of different ratios of C/N, for 19 Mn -6Cr -0.4Si ferrous alloys according to this invention.

FIG. 21 shows that in a different base composition, but still within the scope of this invention, 18 Mn-8 Cr-0.5 Ni-0.8V-0.5 C-0.4 Si, Mo is especially beneficial in improving the stress-corrosion resistance of slow-cooled samples, as well as benefiting the water quenched ones. In the range of 0 to 3.5%, Mo has little effect on work hardening rate or the magnetic characteristics of the alloy. The broad range of Mo in alloys according to this invention is 0.6 to 3.5% and the preferred range is 1.5–3.25%.

VANADIUM

Vanadium increases the work hardening rate. Also in conjunction with the high C or N level characteristic of these alloys, vanadium can provide precipitation hardening when the cold-worked alloy is aged, for example, for 5 to 10 hours at temperatures between about 900°–1200° F (482°–650° C). The aging response is minor below 0.6% V, but becomes significant at 0.8% V and above. The aging reaction seems to be enhanced by the presence of Mo. The disadvantage of aging is that it detracts from the stress-corrosion resistance.

Figure 22:
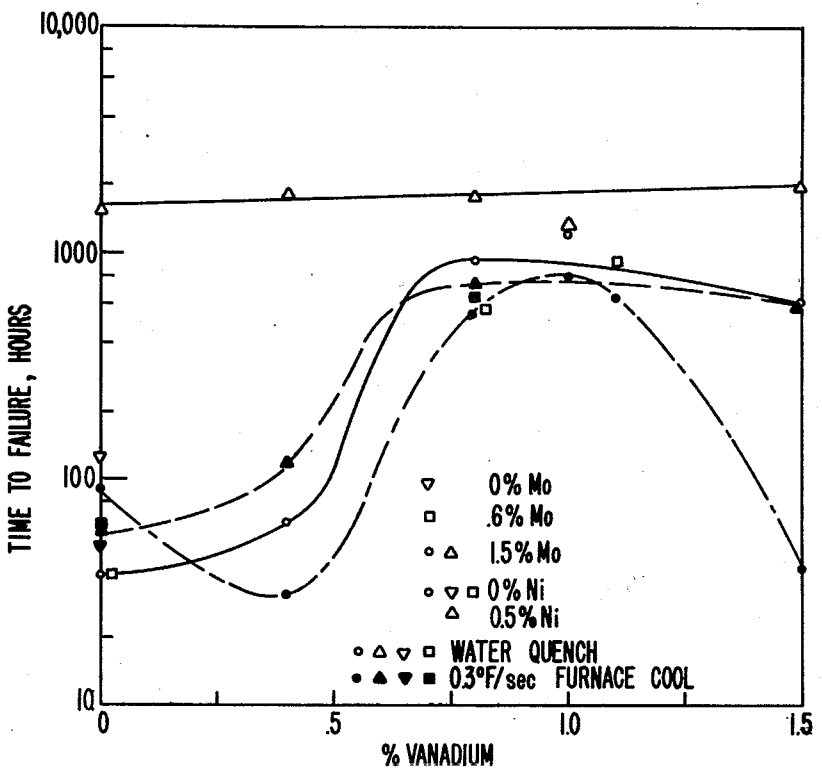
FIG. 22 is a graph showing the effect, on stress-corrosion cracking, of different contents of vanadium on 19 Mn-6 Cr-0.5 C-0.4 Si-1.5 Mo ferrous alloys.

FIG. 22 shows that, in an alloy containing 19 Mn-6 Cr-0.5 Ni-1.5 Mo-0.5 C-0.4 Si, V improves stress-corrosion cracking resistance of water quenched or slow-cooled samples within the range of 0.5–1.5% V. The broad range of V in alloys according to this invention is 0.4–1.7%. Higher V contents decrease bend and tensile ductility and impact energy and could lead to segregation problems. A preferred range of V is 0.75–1.25%. It has been found that with Ni, Mo, and V as indicated, the Cr can be as low as 6%.

COLUMBIUM

Figure 23:
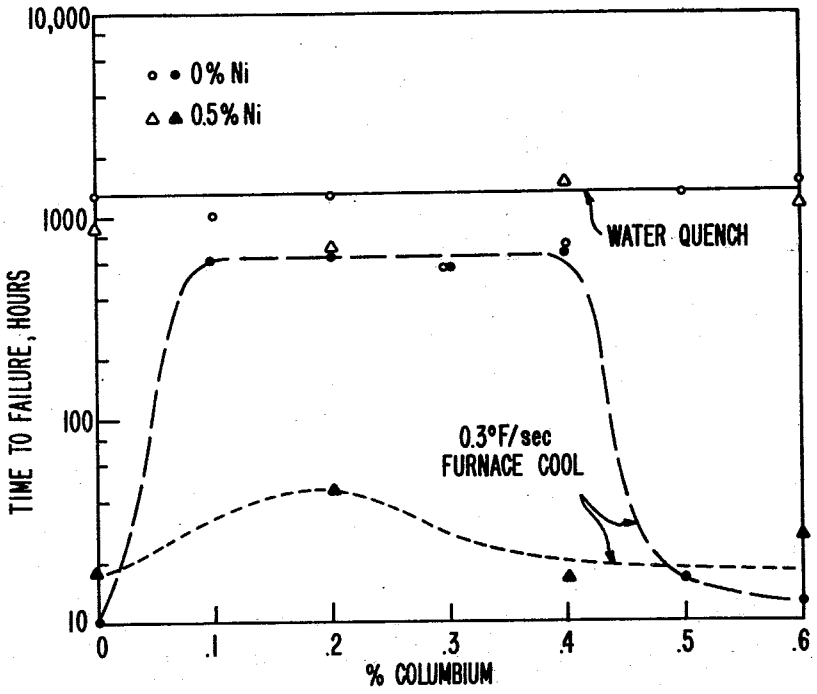
FIG. 23 is a graph showing the effect, on stress-corrosion cracking, of different contents of columbium on 19 Mn-7 Cr-0.55 C-0.4 Si-0.1 N ferrous alloys.

Columbium substantially increases the hardness of the alloys, perhaps through undissolved columbium carbide particles or a refinement of the grain size. Cb does not influence stress-corrosion craking of water quenched samples, but it is helpful in reducing SCC in slow-cooled specimens (FIG. 23). The broad range for Cb in alloys according to this invention is 0.05–0.45%. Cb in excess of 0.5% could lead to segregation and cracking problems during cold expansion. The preferred range for Cb is 0.1–0.4%.

CARBON

The hardness and strength of Mn-Cr austenitic alloys is strongly influenced by the carbon content. In the solution treated condition, carbon is retained in interstitial solid solution. Carbon stabilizes the austenite and increases the strength and work hardening rate of the alloy. Hardness can be related to the carbon content by the following equation for an 18 Mn-5 Cr alloy with 30% cold reduction of area:

Diamond Pyramid Hardness = 346 + 135(% C).

The broad range of carbon in alloys according to this invention is 0.35–0.8%. At lower levels the desired strengths could not be obtained; at higher levels the ductility and impact strength would be impaired. The preferred range of carbon is 0.45–0.65%.

NITROGEN

Nitrogen behaves much like carbon in that it dissolves interstitially, stabilizes the austenite, and increases strength and work hardening rate. Nitrogen, when substituted wholly or substantially for carbon, improves the stress-corrosion resistance of the alloy. For example, in FIG. 24 for an alloy containing 19 Mn-6 Cr-0.5 C-0.4 Si, substitution of N for 40% of more than the C increased failure time of slowly cooled specimens by approximately 10 times. The broad range of N in alloys according to this invention is 0–0.8%, with the restriction that (C+N) = 0.35–0.8%. Care and special procedures in melting, such as melting and casting under a positive pressure of nitrogen, may be required to achieve nitrogen contents of 0.3–0.8%. If nitrogen is substituted for carbon, the chromium can be as low as 6%.

ADDITIONAL INVESTIGATION

Based on the above-described screening tests of U-bends for stress-corrosion cracking susceptibility, 50-pound laboratory heats were prepared of several alloys for evaluation of tensile and impact properties and also their stress-corrosion cracking and $K_{IH_2}$ and $K_{IH_2S}$ characteristics. Compositions of the heats are listed in the following Table III:

TABLE III

Analyzed Compositions of 50-lb. Heats in Weight Percent (Balance essentially iron)

| Heat No. VM | Mn | Cr | C | Si | Ni | Mo | V | Cb | N |
|---|---|---|---|---|---|---|---|---|---|
| 2045 | 17.2 | 5.09 | .51 | (.4)# | <.03 | | | | |
| 1921 | 19.5 | 5.09 | .33 | (.4) | .47 | | | | |
| 1926 | 18.9 | 5.04 | .022 | (.4) | | | | | .22 |
| 1923 | 26.2 | 5.02 | .42 | .39 | | | | | |
| 1924 | 20.0 | 14.9 | .48 | (.4) | | | | | |
| 2046* | 18.6 | 6.21 | .20 | (.4) | | | | | .15 |
| 1927* | 22.1 | 6.47 | .44 | (.4) | | | | | |
| 1925* | 19.5 | 8.08 | .47 | (.4) | | | | | |
| 2041* | 19.2 | 7.15 | .53 | (.4) | .54 | <.05 | | .34 | .19 |
| 2042* | 18.1 | 7.18 | .51 | .38 | .53 | .82 | | | |
| 2044* | 17.2 | 8.58 | .47 | (.4) | .54 | 1.62 | 1.53 | | |
| 2043* | 18.1 | 7.45 | .49 | (4.) | .53 | 1.84 | .78 | | |
| 1928* | 18.9 | 8.03 | .43 | (.4) | .50 | 3.02 | .80 | | |

#(.4) - Nominal.
*Alloys within scope of invention.

Chill cast ingots were homogenized 18 hours at 2,150° F (1,177° C), hot forged at 2,050°–2,100° F (1,121°–1,177° C) and hot rolled to billets, bar and strip at 1,900° F (1,038° F). Following solution treatment and water quenching, the billets were cold rolled to 1⅛ in. × 2¼ in. cross-section (35.7% reduction of area) to provide for fracture toughness tests in hydrogen and hydrogen sulphide. The bar stock was cold swaged with nominal reductions of area of 0, 15, 25, 34 and 42% to determine how the yield strength and ductility were influenced by the level of cold work. The strip stock after solution treatment was cooled at three different rates to study the effect of cooling rate on sensitization:

Water quench — high rate

3° F/second — intermediate rate 0.3° F/second — low rate

The intermediate rate approximates the rate at the midwall position of a retaining ring given a good water quench. The slowest rate corresponds to the slow rate used in the screening tests. The strips were cold rolled with 35% reduction of area.

The tensile properties of these alloys, as a function of percent reduction of area by cold swaging, are listed in the following Table IV.

TABLE IV

Room Temperature Tensile and Impact Properties of Several Alloys as a Function of Cold Work

| VM Heat No. and Code | Solution Temp. ° F | % RA by Cold Swaging | DPH | Charpy V-Notch ft-lbs | 0.2% Yield Strength ksi | Ultimate Strength ksi | Total Elong. % | Red. of Area % |
|---|---|---|---|---|---|---|---|---|
| 1921 B | 1900 | 0 | 203 | 238 | 50.6 | 125.4 | 81.8 | 64.7 |
| C | | 15.5 | 332 | 116 | 106.0 | 148.3 | 46.4 | 56.3 |
| D | | 26.0 | 371 | 76 | 152.6 | 171.0 | 30.5 | 54.4 |
| E | | 33.1 | 392 | 63 | 164.8 | 180.9 | 25.0 | 52.3 |
| F | | 41.2 | 404 | 40 | 200.0 | 213.0 | 14.1 | 47.4 |
| 1923 B | 1900 | 0 | 183 | 230 | 47.4 | 137.6 | 82.6 | 69.8 |
| C | | 16.6 | 313 | 128 | 105.9 | 140.1 | 45.9 | 62.4 |
| D | | 24.8 | 354 | 86 | 141.8 | 159.8 | 34.0 | 58.9 |
| E | | 33.6 | 376 | 68 | 166.3 | 174.8 | 24.0 | 54.2 |
| F | | 41.5 | 395 | 49 | 186.9 | 206.0 | 16.1 | 51.9 |
| 1924 B | 2100 | 0 | 196 | 171 | 56.7 | 124.6 | 71.6 | 63.6 |
| C | | 17.7 | 338 | 62 | 129.9 | 155.9 | 35.3 | 52.1 |
| D | | 23.3 | 366 | 40 | 155.0 | 167.0 | 27.5 | 49.8 |
| E | | 34.0 | 394 | 29 | 191.4 | 197.8 | 15.7 | 42.8 |
| F | | 42.7 | 405 | 20 | 203.0 | 224.6 | 9.2 | 34.6 |
| 1925 B | 1970 | 0 | 207 | 221 | 52.6 | 125.2 | 79.1 | 63.1 |
| C | | 16.4 | 330 | 104 | 112.2 | 150.0 | 43.9 | 59.2 |
| D | | 25.2 | 370 | 72 | 151.8 | 169.0 | 31.4 | 55.2 |
| E | | 33.7 | 390 | 54 | 178.9 | 188.9 | 21.4 | 49.8 |
| F | | 42.4 | 405 | 29 | 200.0 | 220.6 | 12.9 | 46.2 |
| 1926 B | 1900 | 0 | 207 | 224 | 47.1 | 126.9 | 66.7 | 68.2 |
| C | | 14.9 | 291 | 86 | 106.1 | 148.2 | 42.4 | 64.8 |
| D | | 24.6 | 336 | 43 | 144.1 | 168.0 | 27.2 | 56.3 |
| E | | 32.0 | 367 | 17 | 145.4 | 184.8 | 22.0 | 54.7 |
| F | | 40.8 | 401 | 17 | 185.1 | 207.5 | 17.1 | 44.6 |
| 1927 B | 1900 | 0 | 205 | 210 | 49.0 | 134.0 | 79.9 | 66.1 |
| C | | 14.0 | 317 | 114 | 110.0 | 148.0 | 44.6 | 58.5 |
| D | | 25.1 | 368 | 81 | 148.0 | 165.0 | 33.0 | 55.2 |
| E | | 33.2 | 385 | 65 | 166.8 | 183.9 | 24.3 | 50.3 |
| F | | 41.8 | 394 | 41 | 203.8 | 211.8 | 15.7 | 50.5 |
| 2041 DO | 2100 | 0 | | 177 | 68.2 | 144.5 | 64.5 | 60.5 |
| D | | 25.4 | 413 | 43 | 200.0 | 201.0 | 26.3 | 48.2 |
| E | | 35.6 | 432 | 23 | 231.2 | 241.2 | 12.6 | 42.4 |
| F | | 41.9 | 441 | 18 | 253.3 | 261.3 | 94 | 40.3 |
| 2042 DO | 1900 | 0 | | >240 | 53.3 | 134.2 | 65.1 | 61.9 |
| D | | 24.3 | 364 | 101 | 158.8 | 176.9 | 32.4 | 54.6 |
| E | | 36.6 | 371 | 60 | 219.1 | 220.1 | 12.2 | 43.7 |
| F | | 42.4 | 413 | 46 | 238.2 | 243.2 | 9.6 | 39.4 |
| 2043 DO | 2030 | 0 | | >240 | 60.6 | 125.5 | 69.1 | 65.6 |
| D | | 26.6 | 368 | 96 | 167.8 | 177.9 | 28.6 | 55.7 |
| E | | 36.6 | 396 | 68 | 213.1 | 216.1 | 14.7 | 47.0 |
| F | | 42.1 | 406 | 51 | 238.2 | 238.2 | 9.9 | 43.7 |
| 2043 DA, EA, FA* | 2030 | 26.6 | 409 | 92 | 173.4 | 189.9 | 27.5 | 49.8 |
| | | 36.6 | 409 | 58 | 216.1 | 221.1 | 20.2 | 40.7 |
| | | 42.1 | 441 | 37 | 243.2 | 248.2 | 10.4 | 38.6 |
| 2044 DO | 2100 | 0 | | >240 | 62.6 | 122.3 | 66.4 | 68.5 |
| D | | 26.3 | 375 | 92 | 169.8 | 178.9 | 26.7 | 53.8 |
| E | | 36.7 | 391 | 57 | 216.6 | 218.1 | 13.0 | 49.4 |
| F | | 42.9 | 406 | 42 | 238.2 | 241.2 | 10.3 | 44.5 |
| 2044 DA, EA, FA* | 2100 | 26.3 | 409 | 64 | 188.4 | 200.0 | 24.4 | 43.3 |
| | | 36.7 | 434 | 41 | 228.1 | 232.2 | 13.7 | 44.5 |
| | | 42.9 | 451 | 24 | 253.3 | 260.3 | 9.9 | 32.3 |

TABLE IV-continued

Room Temperature Tensile and Impact Properties of Several Alloys as a Function of Cold Work

| VM Heat No. and Code | Solution Temp. ° F | % RA by Cold Swaging | DPH | Charpy V-Notch ft-lbs | 0.2% Yield Strength ksi | Ultimate Strength ksi | Total Elong. % | Red. of Area % |
|---|---|---|---|---|---|---|---|---|
| 2045 DO | 1900 | 0 | 358 | >240 | 51.0 | 128.5 | 77.6 | 65.9 |
| D | | 26.3 | 396 | 77 | 156.8 | 173.9 | 29.5 | 50.3 |
| E | | 36.2 | 406 | 39 | 207.0 | 207.0 | 13.0 | 42.0 |
| F | | 41.9 | | 41 | 225.1 | 228.1 | 12.2 | 51.1 |
| 2046 DO | 1900 | 0 | | >240 | 51.1 | 115.6 | 59.6 | 70.6 |
| D | | 24.1 | 358 | 39 | 165.8 | 172.9 | 22.4 | 52.7 |
| E | | 35.5 | 360 | 17 | 205.5 | 206.0 | 12.0 | 43.7 |
| F | | 42.8 | 370 | 22 | 215.1 | 222.1 | 10.3 | 42.9 |
| 1928 B | 2035 | 0 | 252 | 200 | 60.7 | 123.8 | 77.7 | 66.9 |
| C1 | | 17.6 | 332 | 100 | 127.0 | 155.0 | 40.8 | 55.4 |
| D1 | | 26.1 | 383 | 71 | 161.5 | 172.1 | 29.1 | 52.5 |
| E1 | | 34.1 | 408 | 60 | 192.9 | 198.5 | 22.9 | 53.5 |
| F1 | | 42.5 | 410 | 40 | 214.0 | 224.1 | 12.7 | 49.4 |
| 1928 CA | 2035 | 17.6 | 362 | | 137.8 | 162.3 | 41.3 | 56.3 |
| DA | | 26.1 | 402 | | 173.3 | 185.3 | 30.0 | 46.7 |
| EA | | 34.1 | 449 | | 206.3 | 209.8 | 22.7 | 52.1 |
| FA | | 42.5 | 505 | | 234.7 | 240.7 | 15.3 | 44.5 |

*Compare C through F item by item — shows increased hardening by aging 5 hours at 1000° F (538° C) after cold working.

The points of particular interest with respect to Table Iv are that heats 1923 (26.2% Mn, 5.02% Cr) and 1926 (18.9% Mn, 5.04% Cr, 0.22% N) have low rates of work hardening, and that heat 1924 (20.0% Mn, 14.9% Cr) has low tensile ductility. Aging heats such as 1928, 2043 and 2044, which contain V, can produce a substantial increase in strength without detracting appreciably from the ductility. For example, heat 1928 with 34% RA by cold working and aging 5 hours at 1000° F (538° C) has a yield strength of 206 ksi with 52% reduction of area. Heat 2041, containing Cb, has exceptionally high strength properties, even without aging.

Table IV also shows that Charpy V-notch impact energy (toughness) drops off as would be expected with increasing degree of prior cold work. Heats 1924, 1926, 2041 and 2044 have considerably lower impact energies than the other heats.

All the heats were non-ferromagnetic except 1926, which at a level of only 0.24% (C+N) transformed during deformation to about 10% ferromagnetic martensite.

Results of U-bend tests in two solutions, 0.17% $KHCO_3$ and 3.5% NaCl both in distilled water are presented in the following Table V.

TABLE V

U-Bend Stress-Corrosion Tests of Experimental Retaining Ring Alloys. (Failure Time in Hours)

| Alloy No. VM Cooling Rate | Solution # | Aging | 1921 | 1923 | 1924 | 1925 | 1926 | 1927 | 1928 | 2045 | 2046 | 2042 | 2041 | 2043 | 2044 |
|---|---|---|---|---|---|---|---|---|---|---|---|---|---|---|---|
| Water Quench (Code 1) | $KHCO_3$ | — | 453 | 3200 | 4050+ | 4050+ | 4050+ | 168 | 4050+ | 166 | 2600+ | 1750 | 2600+ | 2600+ | 2600+ |
| " | NaCl | — | 453 | 860 | 4050+ | 1820 | 1 | 1030 | 4050+ | 340 | 430 | 2060 | 2060 | 2060 | 2600+ |
| " | $KHCO_3$ | * | | | | | | | 740 | 290 | 2600+ | X | X | 60 | 40 |
| " | NaCl | * | | | | | | | | X | 340 | X | X | 197 | 197 |
| 2-3° F/sec (Code 3) | $KHCO_3$ | — | X | 654 | 18 | X | 1 | 42 | 2660 | X | 1600+ | 45 | 1600 | 40 | 96 |
| " | NaCl | — | X | 654 | 18 | X | 1 | 236 | 453 | X | 168 | 100 | 90 | 168 | 96 |
| " | $KHCO_3$ | * | | | | | | | 138 | X | 384 | 16 | 24 | 10 | 18 |
| " | NaCl | * | | | | | | | | X | 168 | 12 | 31 | 100 | 48 |
| 0.3° F/sec (Code 2) | $KHCO_3$ | — | X | 168 | X | 8 | 523 | 42 | 66 | 2 | 1850 | 10 | X | 290 | X |
| " | NaCl | — | X | 168 | X | X | 1 | 18 | 168 | 2 | 250 | 18 | X | 166 | X |
| " | $KHCO_3$ | * | | | | | | | 40 | 150 | 1750 | X | X | 40 | X |
| " | NaCl | * | | | | | | | | 190 | 340 | X | X | 18 | X |

#Solutions: 0.17% $KHCO_3$ and 3.5% NaCl
X = broke during bending
* = aged 5 hours at 1000° F.

In the data on which Table V is based, failure time is taken as the time for a stress-corrosion crack to initiate and traverse the full width and penetrate 90% of the thickness of the ⅛ in. thick specimen. The symbol "X" is used to represent a break during cold bending and before immersion in the solution. It will be noted that all the water quenched strips bent satisfactorily, whereas difficulty was sometimes encountered in slow-cooled or aged strips in which grain boundary carbide precipitation could have occurred. Higher Mn, or addition of strong carbide formers, such as Cb, Mo or Mo+V, or N substituted for C improved the bend ductility under adverse cooling conditions.

In these tests, failure time decreased dramatically as the cooling rate from the solution temperature decreased, thus demonstrating again the important of an effective quench. Even water quenching of small strips did not insure immunity to stress-corrosion cracking in all alloys. The quenched alloys with the higher Cr contents, e.g., alloys 1924, 1925, 1928 were the most resistant and some of these were still uncracked after 4050 hours, when testing was discontinued. If a slack quench is likely, the presence of additional elements, such as Ni, Mo and V which were added to heat 1928, is highly desirable. Although aging is beneficial to yield strength, Table V shows that aging detracts from the stress-corrosion resistance of most alloys. Nitrogen, partially substituted for carbon, as in heat 2046, is especially beneficial in improving resistance to stress-corrosion cracking, regardless of cooling rate.

For the determination of fracture toughness ($K_{ISCC}$) in hydrogen and hydrogen sulphide, WOL (wedgeopening-loading) specimens 90 (FIG. 4) were machined from the cold rolled billets and provided with notches 111. Typically, the specimens were about 1.55 inches high (H = 1.55 inches), 2 inches wide (W = 2.0 inches) and 1 inch thick (T = 1 inch). Notches perpendicular to the rolling direction corresponded to the radial orientation in a retaining ring and notches parallel to the rolling direction corresponded to the circumferential orientation. The specimens were precracked to a depth of about 0.20 in. by fatigue at room temperature in air using a $\Delta K$ of 15–20 ksi $\sqrt{in}$.

Rising load $K_{ISCC}$ determinations were performed in chamber 81 (FIG. 4) with either pure $H_2$ or $H_2S$ gas at 50 psig and a continuous loading rate of 20 pounds per minute. Rising load tests in $H_2S$ have been suggested as a useful screening test for $K_{ISCC}$ determinations, because crack growth rates in $H_2S$ gas are of the order of three or four orders of magnitude faster than in either seawater or hydrogen gas for high strength steels. $K_{ISCC}$ is taken as the K value at the point at which the load-displacement curve departs from linearity because of crack growth.

Specimens for static crack growth were placed in a chamber (not shown) which was evacuated and refilled with 80 psig $H_2$ gas. The specimens were bolt loaded (FIG. 3) through vacuum seals to the desired initial stress intensity ($K_i$). If the cracks did not grow in about 1100 hours, it was assumed that $K_{IH_2}$ was $>K_i$.

Results of the determination of $K_{IH_2}$ and $K_{IH_2S}$ in the radial and circumferential crack plane orientations are summarized in the following Tables VI and VII.

TABLE VI $K_{ISCC}$ of Experimental Retaining Ring Alloys in Hydrogen or Hydrogen Sulphide Gas (ksi $\sqrt{in.}$)

| Heat | Rising Load** 50 psig $H_2$ Radial 1 | Bolt Loaded 80 psig $H_2$ Radial 3 | Bolt Loaded 80 psig $H_2$ Circumf. 4 | Rising Load 50 psig $H_2S$ Radial 2 | Rising Load 50 psig $H_2S$ Radial 3* | Rising Load 50 psig $H_2S$ Circumf. 4* | Average 0.2% Yield Strength, ksi |
|---|---|---|---|---|---|---|---|
| 1921 | 97 | >96.3 | >66.2 | 72.7 | 72.4 | 59.8 | 142θ |
| 1923 | 98.8 | >95.8 | >65.7 | 40.6 | 64.4 | 38.5 | 161 |
| 1924 | 105.4 | >99.4 | 65.7 | 69.3 | 84.6 | 55.4 | 157 |
| 1925 | 111.8 | >97.3 | 72.5 | 64.6 | 90.9 | 57.6 | 163 |
| 1926 | 39.3 | 39 | 10.2 | 23.2 | — | — | 142θ |
| 1927 | 100.8 | 87.4 | 74 | 64.8 | — | 62.9 | 161 |
| 1928 | 89.7–99.5 | >97 | >75.2 | >103.4 | 111.8<br>111.6 | 107.4 | 163θ |
| 1928 Agedϕ | 111.3 | | | | 101.2 | 93.1 | 192θ |

*Retest of radial 3.
≠Retest of circumferential 4.
θ>10 ksi spread in yield.
**Loading rate = 20 pounds/minute for all rising load tests.
ϕAged 5 hours at 1000° F (538° C).

TABLE VII $K_{IC}$ and $K_{ISCC}$ Of High Strength Non-Magnetic Alloys In Hydrogen Or Hydrogen Sulphide Gas (Radial Direction)

| Heat No. VM | Cooling Rate Code | Fracture Toughness $K_{IC}$, ksi $\sqrt{in}$ | Stress Corrosion, $K_{ISCC}$ (Apparent)* · ksi $\sqrt{in}$: 50–80 psig $H_2$ | 80 psig $H_2$ Agedϕ | 50 psig $H_2S$ | 50 psig $H_2S$ Agedϕ |
|---|---|---|---|---|---|---|
| 2045 | H | 68 | 68 | | 40 | |
| | J | 65 | 54–65 | | 36 | |
| 1921 | H | | 97 | | 72.5 | |
| 1926 | H | | 39 | | 23 | |
| 1923 | H | | 99 | | 40–64 | |
| 1924 | H | | 105 | | 69–84 | |
| 2046 | H | 63 | 47 | | 34 | |
| | J | 64 | 50 | | 33 | |
| 1927 | H | | 87–101 | | 65 | |
| 1925 | H | | 112 | | 65–90 | |
| 2041 | H | 63 | 60 | | 49 | |
| | J | 50 | 52 | | 47 | |
| 2042 | H | 90 | 84–90 | | 52 | |
| | J | 72 | 72 | | 39 | |
| 2044 | H | 68 | 69 | 54 | 50 | |
| | J | 60 | 50 | 31 | 49 | |
| 2043 | H | 94 | 85 | 61 | 59 | |
| | J | 79 | 70 | 54 | 45 | |
| 1928 | H | | 90–100 | 96–111 | 94–111 | 87–101 |

Code H = water quench.
Code J = about 2° F/sec cooling rate.
ϕAging for 5 hours at 1000° F (538° C)
*Rising Load Test — 20 pounds per minute.

Table VII includes the radial $K_{ISCC}$ data in $H_2$ and $H_2S$ or Table VI and additional data for specimens 2041, 2042, 2043, 2044, 2045 and 2046.

Table VI shows that, in the stress-corrosion threshold tests, $K_{ISCC}$, the $K_{IH_2}$ or $K_{IH_2S}$ strengths of alloy 1926 are drastically lower than for any other alloy in the group. Rising load tests in 50 pisg $H_2$ for the other six alloys have $K_{IH_2}$ around 100 ksi $\sqrt{in.}$ for radial specimens and around 70 for circumferential specimens. Bolt loaded radial specimens have a $K_{IH_s} > 95$ and circumferential specimens $K_{IH_2} > 65$.

Bolt loaded specimens that did not break were unloaded, heat tinted at 500° F (260° C) in air to delineate this intermediate crack position, and retested in rising load $K_{ISCC}$ tests in 50 psig $H_2S$ gas. This provided a check on the original $K_{IH_2S}$ determinations. Rising load tests in $H_2S$ with the circumferential crack orientation have a $K_{IH_2S}$ of about 0.8 of the value in the radial direction (Table VI). However, heat 1928 is remarkable in that both $K_{IH_2}$ and $K_{IH_2S}$ are greater than 100 ksi $\sqrt{in.}$ with either the radial or circumferential crack plane orientation. Moreover, after aging to increase the strength of Heat 1928 to the following:

0.2% yield strength = 203 ksi
Ultimate strength = 217 ksi
Elongation = 14.9%
Reduction of area = 38.2%, $K_{ISCC}$ in $H_2$ and $H_2S$ was maintained at a high level (Table VI), even though resistance to stress-corrosion cracking was adversely affected (Table V).

The following comments are based on the results of the tests on the 50-pound heats: Retaining rings are required to have certain properties and characteristics. In the past, yield strength and impact energy received the greatest attention; but an important feature of this invention is the discovery of alloys that not only have high yield strength and impact energy but which have improved resistance to stress-corrosion cracking, hydrogen embrittlement and environmentally assisted fatigue crack growth rate.

Heat 1923 with the highest manganese content (about 26%) has too low a rate of work hardening. It is not, therefore, a candidate for superstrength retaining rings. Alloy 1924 with the highest chromium content (15%), has adequate strength and good stress-corrosion resistance, but has appreciably lower tensile ductility and impact energy than other alloys. The composition of heat 1926 is not suitable for a retaining ring, because the austenite is not stable. About 10% of the austenite transforms to martensite when it is deformed, and the alloy becomes strongly ferromagnetic. The tensile and impact properties of heat 1926 are also not adequate. The tensile properties of the alloys within the scope of this invention are satisfactory for retaining rings, especially those alloys containing additons of one or more elements from the group consisting of Mo, V and Cb.

In the U-bend stress-corrosion tests, with only one exception, failure time decreases as cooling rate decreased. The quenched alloys with higher chromium contents, e.g., alloys 1924, 1925 and 1928, were the most resistant. Slowly cooled specimens of alloys 1921, 1925, 2045, 2041 and 2044 broke during bending.

Alloy 1926 with martensite present was extremely susceptible to cracking in NaCl. The cracks initiated after only a few minutes and actually progressed across and through the specimens at a visible rate, causing failure within one hour. From other experiments on fully austenitic alloys containing nitrogen, for examples heat 2046 in Table V, it is clear that nitrogen is beneficial rather than detrimental. It is therefore, probable that the high susceptiblity of alloy 1926 to stress-corrosion cracking was due to the presence of martensite, rather than the nitrogen content.

In the event of an inadequate quench, alloys 1923 and 1927 and especially alloys 1928 and 2046 would perform better than the others. However, from the stress-corrosion tests it appears that every precaution should be taken to provide a drastic quench of the retaining rings from the solution temperature.

Based on the discoveries described above, a test ring 44.1 in. ID, 51.1 in. OD and 16.5 in. long was prepared by commercial practices of an alloy within the scope of this invention and having the following composition:

18.1% Mn, 6.45% Cr, 0.73% Si, 0.23% Ni, 0.14% N, 0.14% V, 0.57% C and balance Fe.

After solution treatment and cold expansion the ring was aged 12 hours at 1058° F (570° C).

The midwall, circumferential tensile properties were 0.2% yield strength = 178 ksi
Ultimate strength = 195 ksi
Elongation = 22%
Reduction of area = 35%.

The fracture toughness of the ring in air was > 128 ksi $\sqrt{in.}$; in distilled water, a radial specimen had a $K_{ISCC}$ of 90.2 ksi $\sqrt{in.}$; in 80 psig dry hydrogen, $KI_{IH_2}$ was > 102.6 ksi $\sqrt{in.}$; in 50 psig $H_2S$, $K_{IH_2S}$ was 43 ksi $\sqrt{in.}$ In the circumferential direction, the $K_{ISCC}$ were about half of the above magnitudes. Although these properties are better than those of some prior art retaining ring alloys, the aging given the steel has detracted from its fracture toughness in service environments. Moreover, U-bends of specimens from this ring were susceptible to stress-corrosion cracking in $KHCO_3$ and in NaCl solutions. For the most demanding applications, alloys containing somewhat higher levels of Cr, Ni, Mo, V, Cb and/or N are preferred.

For example, a commercial supplier of retaining rings, based on specifications supplied to him in implementing this invention, manufactured a full-sized retaining ring of one of the preferred compositions according to this invention. The dimensions of the ring after solution treatment were 36.8 in. outside diameter, 25.75 in. inside diameter and 42.8 in. long. The composition of the alloy was: 19.8% Mn, 8.2% Cr, 3.03% Mo, 0.95% V, 0.59% Ni, 0.51% Si, 0.55% C, 0.07% N, 0.026% P, 0.004% S, 0.010% Al, balance Fe. After cold expansion to 48.6 in. OD and 40.0 in. ID to work harden the alloy, the midwall tensile properties were as follows:

| | As Cold Expanded 41.7% | Stress Relieved 10 hours 300° C (572° F) | Aged 10 hours 575° C (1062° F) |
|---|---|---|---|
| 0.2% Yield, ksi | 180–184 | 178.8 | 198 |
| Ultimate, ksi | 187–189 | 189 | 210 |
| Elongation, % | 18.6–3.5 | 22 | 18 |
| Reduction of Area % | 36.6–40.4 | 30 | 27 |

The Charpy V-notch impact strength was about 20 ft. lbs. A test for hydrogen embrittlement was made on an aged specimen in 80 psig hydrogen gas and with a loading rate of 5 pounds/minute. $K_{IH_2}$ had the remarkably high value of 127 ksi $\sqrt{in.}$ in spite of the corresponding high yield-strength level of 198 ksi. These tensile, impact and $K_{ISCC}$ properties satisfy the demanding requirements for retaining rings previously enumerated.

While preferred embodiments of this invention have been disclosed herein many modifications thereof are feasible. This invention is not to be restricted except insofar as is necessitated by the spirit of the prior art.

I claim:

1. Parts for use in electrical generators, said parts having been subjected to a high degree of work hardening in the solution-treated condition, said parts being substantially austenitic and non-ferromagnetic, both as quenched during said solution treatment and after cold working, and having high resistance to stress-corrosion cracking and hydrogen embrittlement, said parts being composed of an alloy consisting essentially of the following compositions in weight percent:

| | |
|---|---|
| Manganese | 17–23 |
| Chromium | >6–<9 |
| Carbon | up to 0.8 |
| Silicon | up to 1.5 |
| Nitrogen | up to 0.8 |
| Nickel | up to 2.75 |
| Molybdenum | up to 3.5 |
| Vanadium | up to 1.7 |
| Columbium | up to 0.45 |
| Iron | Balance, |

the manganese plus chromium being greater than 24 and less than 31.5 and the carbon plus nitrogen being between 0.35 and 0.8.

2. An electrical generator having high strength, nonmagnetic structural parts resistant to stress-corrosion cracking and hydrogen embrittlement, the said parts being composed of the alloy of claim 1.

3. The parts of claim 1 wherein the alloy includes a small but effective quantity of one or more of the elements nickel, molybdenum, vanadium and columbium is included, the nickel being added to maintain a stable austenite in view of the limitation on the quantity of carbon and nitrogen, the molybdenum being added to reduce susceptibility to stress-corrosion cracking in slowly-quenched alloys, the vanadium being added to increase work-hardening rate and to improve stress-corrosion-cracking resistance, the columbian being added to increase the hardness of the alloy.

4. The parts of claim 1 wherein the alloy includes one or more of the following elements in weight percent:

| | |
|---|---|
| Nickel | 0.2 to 2.75 |
| Molybdenum | 0.6 to 3.5 |
| Vanadium | 0.6 to 1.7 |
| Columbium | 0.1 to 0.4. |

5. The parts of claim 1 composed of a wrought steel alloy consisting essentially of the following compositions in weight percent:

| | |
|---|---|
| Manganese | 18 to 22 |
| Chromium | 6.5 to 9 |
| Carbon | 0.45 to 0.65 |
| Silicon | 0.2 to 1 |
| Nickel | 0.4 to 1 |
| Iron | Balance. —. |

6. The parts of claim 1 composed of a wrought steel alloy consisting essentially of the following compositions in weight percent:

| | |
|---|---|
| Manganese | 18 to 22 |
| Chromium | 6.5 to 9 |
| Carbon | 0.45 to 0.65 |
| Silicon | 0.2 to 1 |
| Molybdenum | 0.6 to 1 |

-continued

| | |
|---|---|
| Iron | Balance. |

7. The parts of claim 1 composed of a wrought steel alloy consisting essentially of the following compositions in weight percent:

| | |
|---|---|
| Manganese | 18 to 22 |
| Chromium | 6.5 to 9 |
| Carbon | 0.45 to 0.65 |
| Silicon | 0.2 to 1 |
| Nickel | 0.4 to 1 |
| Molybdenum | 0.6 to 1 |
| Iron | Balance. |

8. The parts of claim 1 composed essentially of a wrought steel alloy consisting essentially of the following compositions in weight percent:

| | |
|---|---|
| Manganese | 18 to 22 |
| Chromium | 6.5 to 9 |
| Carbon | 0.45 to 0.65 |
| Silicon | 0.2 to 1 |
| Molybdenum | 1 to 2 |
| Vanadium | 0.7 to 1.25 |
| Iron | Balance. |

9. The parts of claim 1 composed of a wrought steel alloy consisting essentially of the following composition in weight percent:

| | |
|---|---|
| Manganese | 18 to 22 |
| Chromium | 6.5 to 9 |
| Carbon | 0.45 to 0.65 |
| Silicon | 0.2 to 1 |
| Nickel | 0.4 to 1 |
| Molybdenum | 1 to 2 |
| Vanadium | 0.7 to 1.25 |
| Iron | Balance. |

10. The parts of claim 1 composed of a wrought steel alloy consisting essentially of the following compositions in weight percent:

—

| | |
|---|---|
| Manganese | 18 to 22 |
| Chromium | 6.5 to 9 |
| Carbon | 0.45 to 0.65 |
| Silicon | 0.2 to 1 |
| Nitrogen | 0.05 to 0.15 |
| Columbium | 0.1 to 0.4 |
| Iron | Balance. |

11. Parts for use in electrical generators, said parts having been subjected to a high degree of cold work hardening in this solution-treated condition, said parts being essentially austenitic and non-ferromagnetic, both as quenched during said solution treatment and after cold working, and having a high resistance to stress-corrosion cracking and hydrogen embrittlement, said parts being comprised of a ferrous alloy consisting essentially of the following compositions in weight percent:

| | |
|---|---|
| Manganese | 19 |
| Chromium | 6 |
| Nickel | 0.5 |
| Molybdenum | 1.5 |
| Carbon | 0.5 |
| Silicon | 0.4 |
| Vanadium | 0.75 to 1.25 |
| Iron | Balance. |

12. The parts of claim 1 composed of a wrought steel alloy consisting essentially of the following composition in weight percent:

| | |
|---|---|
| Manganese | 18 to 20 |
| Chromium | 7.5 to 9 |
| Carbon | 0.35 to 0.6 |
| Silicon | 0.3 to 0.6 |
| Nickel | 0.4 to 1 |
| Molybdenum | 2.75 to 3.25 |
| Vanadium | 0.6 to 1.0 |
| Iron | Balance. |

13. The parts of claim 1 composed of the alloy of claim 1 including by weight percent:

0.1 to 0.7 nitrogen and 0.0 to 0.6 carbon and wherein the carbon plus the nitrogen is between 0.35 and 0.7 weight percent.

14. The part of claim 1 composed of the alloy of claim 1 having a vanadium content by weight percent of between 0.6 and 1.7, the said parts having been cold worked and thereafter aged in the cold worked condition at a temperature between 900° F and 1200° F to increase the strength thereof.

15. The part of claim 1 composed of a wrought steel part of the alloy of claim 1 which after being subjected to a temperature in which its component elements are dissolved, has been abruptly quenching from solution temperatures and thereafter cold worked to a high-strength level.

16. The part of claim 1 composed of an alloy whose chromium content is between 6.5% and 9%.

17. Parts for use in electrical generators, said parts having been subjected to a high degree of cold-work hardening in the solution-treated condition, said parts being essentially austenitic and non-ferromagnetic, both as quenched during said solution treatment and after cold working, and having a high resistance to stress-corrosion cracking and hydrogen embrittlement, said parts being comprised of a ferrous alloy consisting essentially of the following composition in weight percent:

| | |
|---|---|
| Manganese | 19 |
| Chromium | 6 |
| Silicon | 0.4 |
| Carbon | 0.2 |
| Nitrogen and Carbon | 0.35 to 0.7 |
| Iron | Balance. |

* * * * *